US010236609B2

(12) United States Patent
Tziviskos et al.

(10) Patent No.: US 10,236,609 B2
(45) Date of Patent: Mar. 19, 2019

(54) CONNECTORS HAVING PRINTED CIRCUIT BOARD TONGUES WITH REINFORCED FRAMES

(71) Applicant: Apple Inc., Cupertino, CA (US)

(72) Inventors: George Tziviskos, Cupertino, CA (US); Paul Joseph Hack, San Jose, CA (US); Yufan Liao, San Jose, CA (US); Mahmoud R. Amini, Sunnyvale, CA (US); James M. Jeon, Mountain House, CA (US); Daniel A. Bergvall, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/714,915

(22) Filed: Sep. 25, 2017

(65) Prior Publication Data

US 2018/0131111 A1 May 10, 2018

Related U.S. Application Data

(60) Provisional application No. 62/399,285, filed on Sep. 23, 2016.

(51) Int. Cl.
*H01R 13/648* (2006.01)
*H01R 12/72* (2011.01)
(Continued)

(52) U.S. Cl.
CPC ..... *H01R 12/721* (2013.01); *H01R 12/79* (2013.01); *H01R 13/22* (2013.01); *H01R 13/516* (2013.01);
(Continued)

(58) Field of Classification Search
CPC ..... H01R 12/721; H01R 13/631; H01R 13/6585; H01R 13/405; H01R 12/79;
(Continued)

(56) References Cited

U.S. PATENT DOCUMENTS 3,539,973 A 11/1970 Wright
5,267,868 A 12/1993 Wolff, Jr.
(Continued)

FOREIGN PATENT DOCUMENTS

CN 201 285 872 8/2009
EP 2 590 273 A2 5/2013
(Continued)

OTHER PUBLICATIONS

International Search Report and Written Opinion dated Feb. 21, 2018 in PCT/US2017/053300, 21 pages.

*Primary Examiner* — Jean F Duverne
(74) *Attorney, Agent, or Firm* — Kilpatrick Townsend & Stockton, LLP

(57) ABSTRACT

Connector tongues that may provide a high signal quality or signal integrity to allow high speed data transfers, may be reliably manufactured, and may be durable and have good wear performance. One example may provide a connector tongue having contacts and traces formed on a printed circuit board. Using a printed circuit board for pathways through a connector tongue may provide low impedances for power traces, matched impedances for differential signal pairs, and shielding. This may provide a connector tongue that may provide a high signal quality or signal integrity to allow high speed data transfers. These and other examples may provide a connector tongue that is durable and has good wear performance by including side retention features on each side of the printed circuit board. The side retention features may be metallic, ceramic, or other durable material.

24 Claims, 18 Drawing Sheets

(51) Int. Cl.

| | |
|---|---|
| ***H01R 13/516*** | (2006.01) |
| ***H01R 13/66*** | (2006.01) |
| ***H01R 24/60*** | (2011.01) |
| ***H01R 12/79*** | (2011.01) |
| ***H01R 13/22*** | (2006.01) |
| ***H01R 13/631*** | (2006.01) |
| ***H01R 13/6594*** | (2011.01) |
| *H01R 107/00* | (2006.01) |

(52) U.S. Cl.
CPC ..... *H01R 13/631* (2013.01); *H01R 13/6594* (2013.01); *H01R 13/6658* (2013.01); *H01R 24/60* (2013.01); *H01R 2107/00* (2013.01)

(58) Field of Classification Search
CPC ..... H01R 12/71; H01R 24/60; H01R 13/22; G02B 6/3893; G02F 1/133308
USPC ..... 439/607.36
See application file for complete search history.

(56) References Cited

U.S. PATENT DOCUMENTS

| | | | | |
|---|---|---|---|---|
| 6,179,627 | B1 | 1/2001 | Daly et al. | |
| 6,734,928 | B2 * | 5/2004 | Ito | G02F 1/133308 349/58 |
| 6,884,094 | B1 | 4/2005 | Bernhart | |
| 7,118,281 | B2 * | 10/2006 | Chiu | G02B 6/3893 385/53 |
| 7,922,535 | B1 | 4/2011 | Jiang | |
| 8,794,981 | B1 * | 8/2014 | Rodriguez | H01R 13/405 439/606 |
| 8,821,181 | B1 | 9/2014 | Lam et al. | |
| 9,093,779 | B1 | 7/2015 | Wang | |
| 9,350,121 | B2 | 5/2016 | Ju | |
| 9,509,084 | B2 | 11/2016 | Zhao | |
| 9,531,113 | B2 | 12/2016 | Ohyama | |
| 9,590,360 | B2 * | 3/2017 | Chuang | H01R 13/6581 |
| 9,806,446 | B2 * | 10/2017 | Lee | H01R 12/71 |
| 9,847,605 | B2 * | 12/2017 | Liao | H01R 13/6585 |
| 2002/0149875 | A1 | 10/2002 | Dague | |
| 2009/0163071 | A1 | 6/2009 | Chen | |
| 2009/0190277 | A1 | 7/2009 | Hiew et al. | |
| 2010/0055986 | A1 | 3/2010 | Wang | |
| 2011/0159747 | A1 | 6/2011 | Tung et al. | |
| 2011/0195606 | A1 | 8/2011 | Hsia | |
| 2011/0230074 | A1 | 9/2011 | Schmidt | |
| 2013/0143441 | A1 | 6/2013 | Huang et al. | |
| 2013/0244494 | A1 | 9/2013 | Tziviskos et al. | |
| 2013/0288520 | A1 | 10/2013 | Simmel et al. | |
| 2013/0330976 | A1 | 12/2013 | Simmel et al. | |
| 2014/0073184 | A1 | 3/2014 | Zhao et al. | |
| 2014/0099835 | A1 | 4/2014 | Chang | |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0263465 | A1 | 9/2015 | Zhang | |
| 2015/0270661 | A1 | 9/2015 | Kao et al. | |
| 2015/0295356 | A1 | 10/2015 | Tziviskos et al. | |
| 2015/0340782 | A1 | 11/2015 | Amini et al. | |
| 2015/0340783 | A1 | 11/2015 | Lee et al. | |
| 2015/0340813 | A1 | 11/2015 | Ng et al. | |
| 2015/0340825 | A1 | 11/2015 | Ng et al. | |
| 2016/0276765 | A1 | 9/2016 | Hwang et al. | |

FOREIGN PATENT DOCUMENTS

| | | | |
|---|---|---|---|
| JP | 2003-059586 | A | 2/2003 |
| JP | 2013-118165 | A | 6/2013 |
| JP | 2013-522846 | A | 6/2013 |
| KR | 10-2010-0050530 | | 5/2010 |
| WO | 2009/017599 | A1 | 2/2009 |

* cited by examiner

CONNECTORS HAVING PRINTED CIRCUIT BOARD TONGUES WITH REINFORCED FRAMES

CROSS-REFERENCES TO RELATED APPLICATIONS

This application claims the benefit of U.S. provisional application No. 62/399,285, filed Sep. 23, 2016, which is incorporated by reference.

BACKGROUND

Power and data may be provided from one electronic device to another over cables that may include one or more wires, fiber optic cables, or other conductors. Connector inserts may be located at each end of these cables and may be inserted into connector receptacles in the communicating or power transferring electronic devices.

These connector receptacles and connector inserts may have various form factors. For example, a connector receptacle may include a tongue in a recess, where a corresponding connector insert fits in the recess and has an opening that accepts the connector receptacle tongue. In another example, a connector insert may include a tongue or may be formed as a tongue that fits in a connector receptacle. In either of these and other connector configuration a connector tongue is used.

Given the large amounts of data that may be transferred among connected devices, it may be desirable that these connector tongues be capable of supporting high data rates. That is, it may be desirable that these connector tongues provide a high signal quality or signal integrity to allow high speed data transfers between electronic devices.

Some of these electronic devices become tremendously popular. As a result, connectors having these connector tongues may be sold in very large quantities. Therefore, it may be desirable that these connector tongues be readily manufactured.

Users may connect and disconnect these connectors many times during a devices' lifetime. If these connector tongues break or show signs of wear prematurely, it may reduce user satisfaction.

Thus, what is needed are connector tongues that may provide a high signal quality or signal integrity to allow high speed data transfers, may be reliably manufactured, and may be durable and have good wear performance.

SUMMARY

Accordingly, embodiments of the present invention may provide connector tongues that may provide a high signal quality or signal integrity to allow high speed data transfers, may be reliably manufactured, and may be durable and have good wear performance.

An illustrative embodiment of the present invention may provide a connector tongue having contacts and traces formed on a printed circuit board. Using a printed circuit board for pathways through a connector tongue may provide low impedances for power traces, matched impedances for differential signal pairs, and shielding. This may provide a connector tongue that may provide a high signal quality or signal integrity to allow high speed data transfers.

These and other embodiments of the present invention may provide a connector tongue that is durable, has good wear performance, and provides a constant level of performance by including side retention features on each side of the printed circuit board. These side retention features may form a portion of a frame that extends along sides of the connector tongue. The side retention features may join near a rear of the connector tongue in a cross-beam, flange, or other bracing structure. When the connector tongue is used in a USB Type-C connector receptacle, ground pads may extend along a top and bottom of the connector tongue joining the side retention features.

In these and other embodiments of the present invention, a front cross-beam at or near a front of the connector tongue may join the side retention features together. The front cross-beam may be covered in plastic to reduce wear on corresponding connectors that are mated with the connector tongue. This plastic may be an overmold that may prevent contacts on a corresponding connector from being shorted or grounded by the front cross-beam when the corresponding connector is mated with the connector tongue. Whether a front of a connector tongue is formed of printed circuit board or plastic covering a front cross-beam, a front of the connector tongue may be chamfered to simplify mating to a corresponding connector. The front of the connector tongue may be pad printed, the plastic may be dyed, or other steps may be taken to improve its cosmetic appearance. Where part of the connector front of the tongue is formed by the printed circuit board and another part of the front of the connector tongue is formed by the frame, different techniques and steps may be needed for each part. These different steps may be arranged such that the printed circuit board and frame have a similar appearance, or they may have contrasting appearances.

In these and other embodiments of the present invention, the frame may be metallic, ceramic, it may be metallic coated with a ceramic, or it may be formed of other material. These frames may increase a strength of a connector tongue as compared to a connector tongue formed only of a printed circuit board. These frames may have good wear performance. A metal frame may be oxidized or coated with a ceramic or other material for increased lubricity for even better wear performance, and to insulate it electrically where necessary. This oxidation or coating may be selective such that portions, such as electromagnetic interference (EMI) plates (if present) and outside edges of side retention features, are not oxidized or coated such that they may make electrical contact with corresponding features on a corresponding connector when the corresponding connector is mated with the connector tongue. In these and embodiments of the present invention, the coating or oxidation may be done using physical vapor deposition (PVD), ion injection, or other process technique. In one example, a titanium frame may be at least partially oxidized to form titanium-oxide on at least a part of the surface of the frame. The use of these materials for side retention features of the frame may also provide a clear tactile and audible response to a user when a user mates a connector having the connector tongue with a corresponding connector, as compared to a plastic or printed circuit board tongue without side retention features.

In various embodiments of the present invention, a frame may be made in different ways. For example, it may be formed using metal-injection molding, 3-D printing, forging, stamping, or other process. The printed circuit board may be made using various techniques. The printed circuit board may be a multilayer board and it may have a central ground plane or other ground planes. The printed circuit board may include multiple layers supporting traces and planes and may further include vias for connecting traces and planes on different layers to each other. Ground connections may be made from a printed circuit board ground plane to the frame. For example, one or more vias may connect the ground plane to top and bottom surfaces of the printed circuit board adjacent to corresponding EMI plates. These EMI plates may then be connected to the printed circuit board ground plane. In these and other embodiments of the present invention, the ground plane may extend to a side of the printed circuit board. The side of the printed circuit board may be edge plated, where the edge plating connects to the ground plane. The edge plating may then be electrically connected to the side retention features to form a ground path.

In these and other embodiments of the present invention, the frame may strengthen and increase the durability of a connector tongue. Portions of the frame may be soldered to the printed circuit board to further strengthen the connector tongue. For example, adjoining sides of the printed circuit board and side retention features may be soldered together. The area under EMI plates (if present) on a top and bottom of the printed circuit board may be soldered, thereby greatly increasing the strength of the connector tongue. Solder paste may be applied to surfaces of the printed circuit board. After the board is pushed into the frame, the solder paste may be heated and the solder may connect these surfaces. Capillary action may cause the solder paste to flow and fill gaps between the printed circuit board and the frame.

In these and other embodiments of the present invention, a printed circuit board of the tongue may be formed of various materials with a reduced concern for their wear or strength since the printed circuit board is reinforced with a frame. This may allow the use of various materials for the printed circuit board for even higher performance. Also, printed circuit board materials may be more freely selected for color, signal quality, aesthetics, availability, or other property.

Various connector tongues may need to meet various spacing requirements for its interface features to be compatible with their interface specifications. For example, the specifications for USB Type-C connector tongues may require specific locations and spacings for contacts relative to outside features of the tongue. The result is that the printed circuit board, on which the contacts may be printed, may need to be accurately aligned in the frame. Accordingly, embodiments of the present invention may provide features on various portions of the connector tongue to improve the alignment of the frame to the printed circuit board.

In a specific embodiment of the present invention, a flange near a rear of the frame may include a somewhat rectangular passage through which a printed circuit board may be inserted during assembly. The flange passage may have angled portions at each of its four corners for at least a part of its length. The printed circuit board may have copper layers on a top side and a bottom side. The copper layers may instead be formed of other metals or other materials. The copper layers may engage the angled corners of the passage as the printed circuit board is inserted through passage in the flange. The copper layers may be crushed at the corners, and the interference between the copper layers and the angled corners may act to center the printed circuit board to the flange and the other portions of the frame as the printed circuit board is inserted. Put another way, the copper may act as a crush-rib to provide force to align the printed circuit board to the frame. This technique may align the printed circuit board to the frame in the Y direction (laterally along the front of the connector tongue) and the Z direction (in a direction orthogonal or normal to the top and bottom surfaces of the connector tongue.

In another specific embodiment of the present invention, the inside edge of each side retention feature of the frame may include a rib or nub for a portion of its length. The ribs or nubs on the inside edges of the side retention features may engage sides of the printed circuit as the printed circuit board is inserted into the frame. These ribs may push or cut into the sides of the softer printed circuit board. This force may act to center the printed circuit board to the side retention features and the other portions of the frame as the printed circuit board is inserted. The spacing of the ribs to the outside edges of the side retention features may be accurately controlled. This may improve the control of the position of the contacts on the printed circuit board relative to the outside edges of the side retention features.

These connector tongues may be used in connector receptacles. A recess or opening in a device enclosure may form a housing or opening for the connector receptacle, into which a connector tongue may be inserted. Accordingly, embodiments of the present invention may provide apparatus and methods for assembling and aligning a connector tongue to an opening in a device enclosure. These and other embodiments of the present invention may provide apparatus and methods that combine an insertion and an alignment of a printed circuit board into a frame of a connector tongue with an insertion and alignment of a connector tongue into an opening in a device enclosure.

These and other embodiments of the present invention may provide a reflow cap that may have an outer edge to fit in a device enclosure. During assembly, the reflow cap and connector tongue may be inserted from opposite sides into the device enclosure, in order to provide Y- and Z-alignment of the tongue 210 to the device enclosure. The reflow cap may have a wide portion that fits in the opening of the device enclosure. Crush ribs on an outside surface of the reflow cap may accurately position the reflow cap in the opening in the device enclosure. The connector tongue may be inserted to a depth where a front edge of the flange may be against an inside edge of the device enclosure, whereas reflow cap 910 may be inserted from the opposite side of the device enclosure to provide Y- and Z-alignment of the tongue 210 to the opening of the device enclosure. Crush ribs on an inside surface of the reflow cap may help to accurately position the frame to the reflow cap and therefor to the device enclosure opening. The printed circuit board may then be inserted into the frame while the frame is held in place by the reflow cap. The reflow cap may in turn be held in place by a press-in tool. Additional crush ribs on an inside surface of the reflow cap may position the printed circuit board relative to the frame in the Z direction, such that gaps between the printed circuit board and frame are maintained to provide space for solder to flow during solder reflow. Crush ribs may also form interstitial walls that align and position contacts of the printed circuit board relative to the frame in the Y direction. The printed circuit board may be inserted until it reaches an end surface of an inside of the reflow cap. After insertion into the frame, the printed circuit board may be fixed to the frame, and the frame may be fixed to the device enclosure or other structure associated with the device enclosure. The reflow cap may remain installed during assembly and shipping to protect the connector tongue from damage from physical contact and discoloration from overheating, though it may be removed at some point before or after this and recycled. In this example, the ribs or nubs on the side retention features may align the printed circuit board to the frame in the Y direction (laterally along the front of the connector tongue), while the reflow cap may align the printed circuit board to the frame in the Z direction (a direction orthogonal or normal to the top and bottom surfaces of the connector tongue and the X direction (the direction of insertion of the printed circuit board into the frame.) Accurate positioning in the Z direction may facilitate the positioning of EMI plates (if present) of the frame relative to the printed circuit board surfaces.

In various embodiments of the present invention, standoffs located on the front edge of the flange may be used, with or without the reflow cap, to align the connector tongue in the opening of the device enclosure. The standoffs may be attached to, or formed as part of, a front of the flange of the frame. These standoffs may provide space for conductive foam to be placed between the front surface of the flange of the frame and an inside surface of the device enclosure to provide ground paths from the frame to the device enclosure.

In these and other embodiments of the present invention, the printed circuit board for the tongue may be formed of a top printed circuit board, an intervening flexible circuit board, and a bottom printed circuit board. Contacts on adjacent surfaces of the top printed circuit board and the intervening flexible circuit board may connect to each other. Contacts on adjacent surfaces of the bottom printed circuit board and the intervening flexible circuit board may also connect to each other. Tongue contacts on a top side of the top printed circuit board may connect to contacts that connect to the flexible circuit board. Tongue contacts on a bottom side of the bottom printed circuit board may connect to contacts that connect to the flexible circuit board. The flexible circuit board may thus provide pathways between tongue contacts and other circuits and components in an electronic device housing the connector receptacle tongue. In these and other embodiments of the present invention, a connector receptacle tongue may include contacts that may connect to a flexible circuit board, where the flexible circuit board connects to other circuits and components in the device. This arrangement may provide a highly flexible routing structure having good signal integrity and impedance matching.

In these and other embodiments of the present invention, one or more electronic devices or components, such as data retiming circuits, impedance circuits, light-emitting diodes, and others may be located on a printed circuit board of a connector tongue and may be connected to contacts and other connections to the printed circuit board through traces in the printed circuit board.

While embodiments of the present invention may be useful as connector tongues in USB Type-C connector receptacles, these and other embodiments of the present invention may be used as connector tongues in other types of connectors for different interfaces.

In various embodiments of the present invention, frames, shields, and other conductive portions of a connector tongue may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the reflow caps and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide connector tongues for connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles and connector inserts that may be used to provide a reduced set of functions for one or more of these standards. In various embodiments of the present invention, these interconnect paths provided by these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
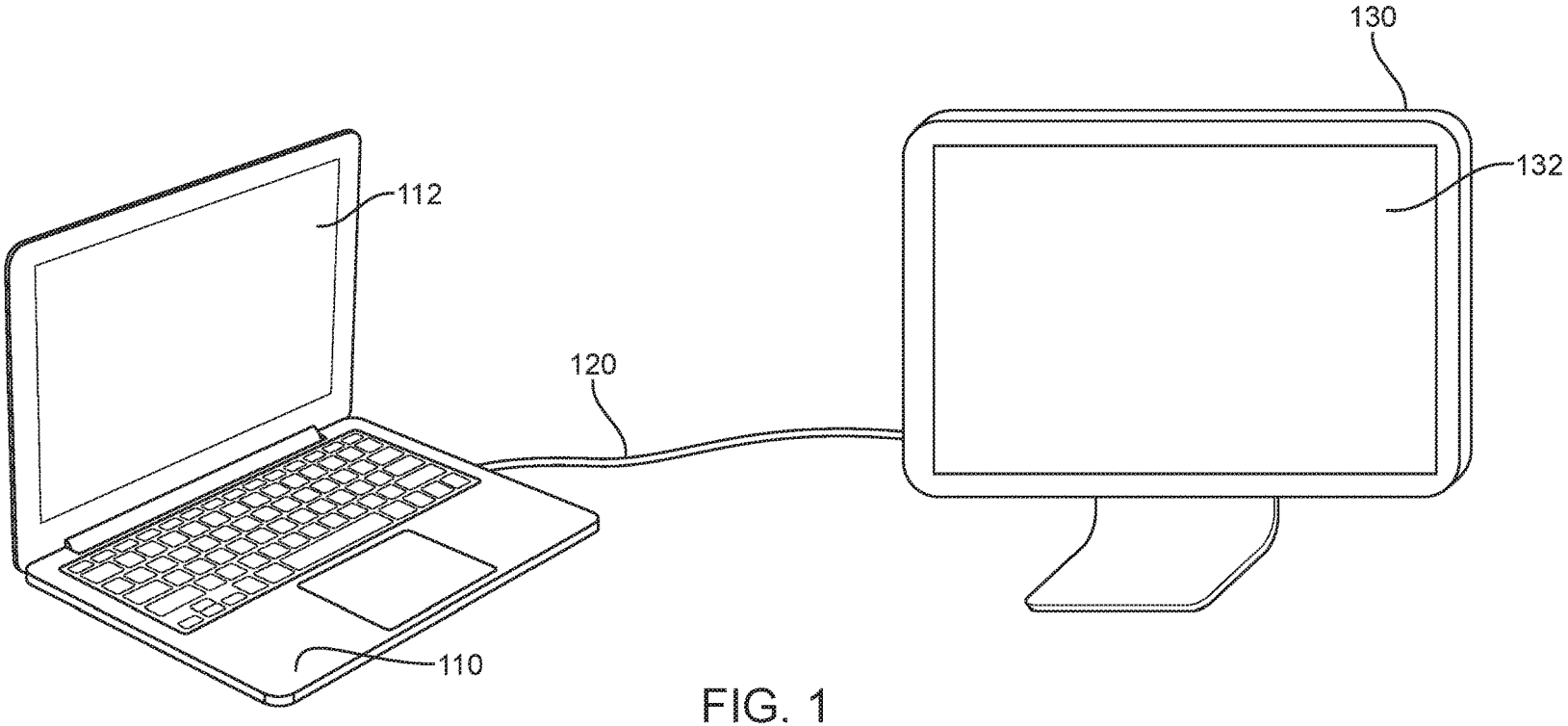
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates monitor 130 that may be in communication with computer 110. Computer 110 may provide video or other data over cable 120 to monitor 130. Video data may be displayed on the video screen 132 of monitor 130. Computer 110 may similarly include a screen 112. In other embodiments the present invention, other types of devices may be included, and other types of data may be shared or transferred among the devices. For example, monitor 130 may be a monitor, an all-in-one computer, tablet computer, or other device. In these and other embodiments of the present invention, power may be shared between computer 110 and monitor 130 over cable 120.

Cable 120 may be one or a number of various types of cables. For example, it may be a Universal Serial Bus (USB) cable such as a USB Type-C cable, Thunderbolt, DisplayPort, Lightning, or other type of cable. Cable 120 may include compatible connector inserts (not shown) that plug into connector receptacles (not shown) on the computer 110 and monitor 130.

These connector receptacles and connector inserts may have various form factors. For example, a connector receptacle may include a tongue in a recess, where a corresponding connector insert fits in the recess and has an opening that accepts the connector receptacle tongue. In another example, a connector insert may include a tongue or may be formed as a tongue that fits in a connector receptacle. In either of these and other connector configurations a connector tongue is used. An example of a connector tongue that may be used in a connector receptacle is shown in the following figure.

Figure 2:
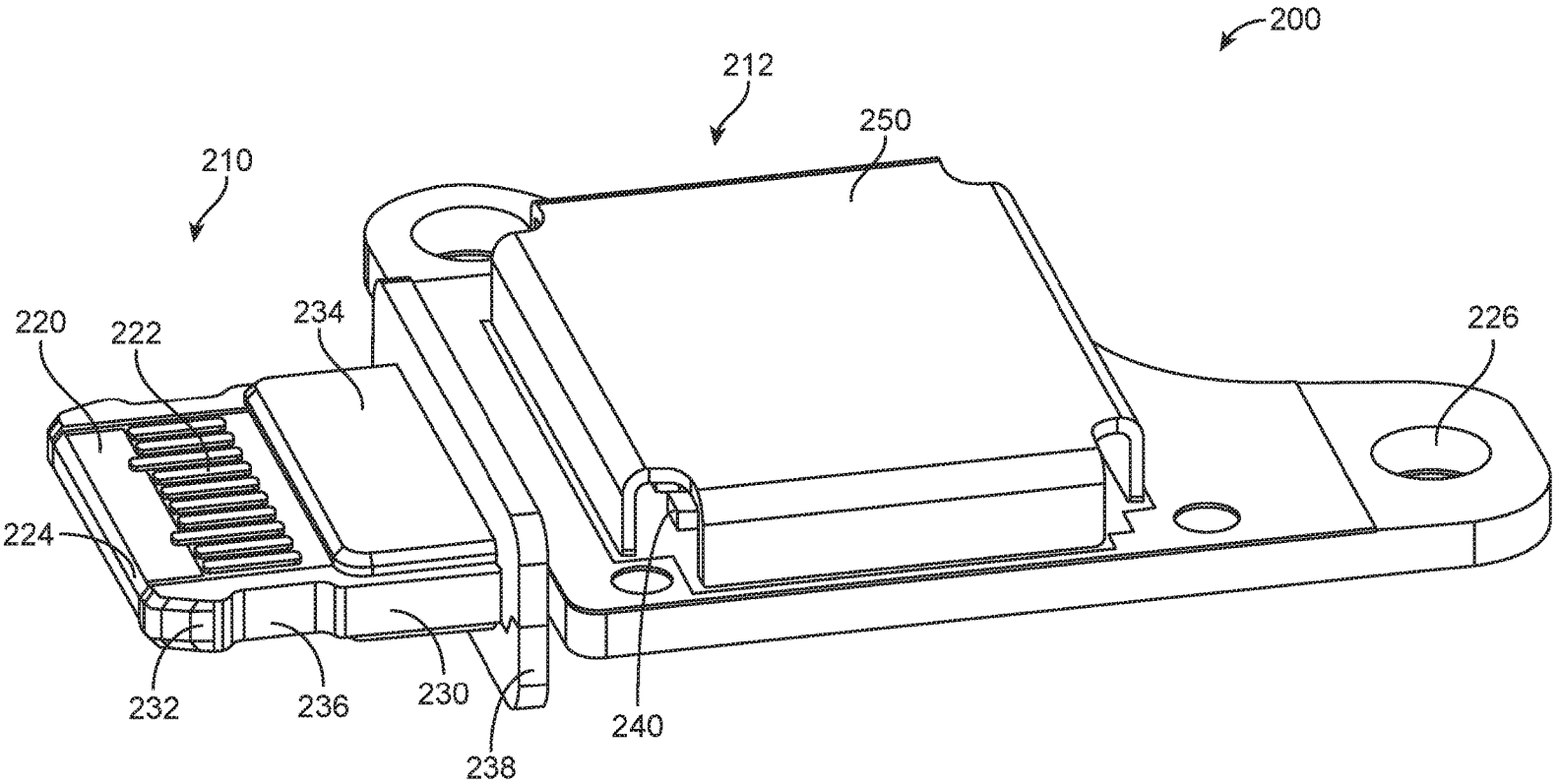
FIG. 2 illustrates a connector receptacle board having a connector tongue according to an embodiment of the present invention.

FIG. 2 illustrates a connector receptacle board having a connector tongue according to an embodiment of the present invention. Connector receptacle board 200 may include a connector tongue 210 and a rear portion 212. Connector tongue 210 may be formed of a printed circuit board 220 and frame 230. Printed circuit board 220 may incorporate contacts 222 on a top side, a bottom side, or both. Printed circuit board 220 may provide pathways (not shown) through connector tongue 210 (and the remaining rear portion 212 of connector receptacle board 200) that may provide low impedances for power traces (not shown), matched impedances for differential signal pairs (not shown), and shielding for both. Printed circuit board 220 may provide a connector tongue 210 that may provide a high signal quality or signal integrity to allow high speed data transfers.

Connector tongue 210 may further include frame 230. Frame 230 may provide a connector tongue that is durable, has good wear performance, and provides a constant level of performance. Frame 230 may include side retention features 232 on each lateral side of printed circuit board 220, where the lateral sides are between the top and bottom sides of printed circuit board 220. Side retention features 232 may form a portion of frame 230 that extend along sides of connector tongue 210. Side retention features 232 may be joined near a rear of the connector tongue by flange 238. When the connector tongue is used in a USB Type-C connector receptacle, EMI plates 234 may extend along a top and bottom of the connector tongue 210 joining side retention features 232 on a top and bottom of connector tongue 210.

In these and other embodiments of the present invention, a front cross-beam (not shown) at or near a front 224 of connector tongue 210 may join side retention features 232 together. The front cross-beam may be covered in plastic (not shown) to reduce wear on corresponding connectors that are mated with the connector tongue. This plastic may be an overmold that may prevent contacts on a corresponding connector (not shown) from being shorted or grounded by the front cross-beam when the corresponding connector is mated with connector tongue 210. Whether a front of connector tongue 210 is formed of printed circuit board 220 or plastic covering a front cross-beam, front 224 of connector tongue 210 may be chamfered to simplify mating to a corresponding connector. Front 224 of connector tongue 210 may be pad printed, the plastic may be dyed, or other steps may be taken to improve its cosmetic appearance. Where part of front 224 of connector tongue 210 is formed by printed circuit board 220 and another part of front 224 of the connector tongue 210 is formed by frame 230, different techniques and steps may be needed for each part. These different steps may be arranged such that printed circuit board 220 and frame 230 look similar, or they may have contrasting appearances.

In these and other embodiments of the present invention, frame 230 may be metallic or ceramic, it may be metallic coated with a ceramic, or it may be formed of other material. Frame 230 may increase a strength of connector tongue 210 as compared to a connector tongue formed only of printed circuit board 220. Frame 230 may have good wear performance. A metal frame 230 may be oxidized or coated with a ceramic or other material for increased lubricity for even better wear performance, and to insulate it electrically where necessary. This oxidation or coating may be selective such that portions, such as EMI plates 234 and notches 236 of side retention features 232, are not oxidized or coated such that they may make electrical contact with corresponding features on a corresponding connector (not shown) when the corresponding connector is mated with connector tongue 210. Specifically, EMI plates 234 may be exposed such that they may make electrical contact with ground contacts (not shown) near a front of a USB Type-C connector insert (not shown). Notches 236 may be exposed such that they make electrical contact with side retention springs in sides of an opening in a USB Type-C connector insert. In these and embodiments of the present invention, the coating or oxidation may be done using physical vapor deposition (PVD), ion injection, or other process technique. In one example, a titanium frame 230 may be at least partially oxidized to form titanium-oxide on at least a part of the surface of frame 230.

The use of these materials for side retention features 232 of frame 230 may also provide a clear tactile and audible response to a user when a user mates a connector having connector tongue 210 with a corresponding connector, as compared to a plastic or printed circuit board tongue without side retention features 232.

In various embodiments of the present invention, frame 230 may be made in different ways. For example, frame 230 may be formed using metal-injection molding, 3-D printing, forging, stamping, or other process. Printed circuit board 220 may be made using various techniques. Printed circuit board 220 may be a multilayer board and it may have a central ground plane or other ground planes (not shown). Printed circuit board 220 may be a multilayer printed circuit board comprising a plurality of traces (not shown) on each of a plurality of layers (not shown), and further comprising a plurality of vias (not shown) each connecting two traces on different layers in the plurality of layers to each other. Printed circuit board 220 may include multiple layers supporting traces and planes (not shown) and may further include vias for connecting traces and planes on different layers to each other. Ground connections (not shown) may be made from a ground plane (not shown) in printed circuit board 220 to frame 230. For example, one or more vias (not shown) may connect the ground plane to top and bottom surfaces of printed circuit board 220 adjacent to EMI plates 234. EMI plates 234 may then be connected to the ground plane in printed circuit board 220. In these and other embodiments of the present invention, the ground plane may extend to a side of printed circuit board 220. The side of printed circuit board 220 may be edge plated, where the edge plating (not shown) connects to the ground plane. The edge plating may then be electrically connected to side retention features 232 to form a ground path.

In these and other embodiments of the present invention, frame 230 may strengthen and increase the durability of connector tongue 210. Portions of frame 230 may be soldered to printed circuit board 220 to further strengthen connector tongue 210. For example, adjoining sides of printed circuit board 220 and side retention features 232 may be soldered together. The area between EMI plates 234 and a top and bottom of printed circuit board 220 board may be soldered, thereby greatly increasing the strength of connector tongue 210. Solder paste may be applied to surfaces of printed circuit board 220. After printed circuit board 220 is pushed into frame 230, the solder paste may be heated and the solder may connect these surfaces. Capillary action may cause the solder paste to flow and fill gaps between printed circuit board 220 and frame 230.

In these and other embodiments of the present invention, one or more electronic devices or components 240, such as data retiming circuits, impedance circuits, light-emitting diodes, and others may be located on printed circuit board 220 on a rear portion of connector receptacle board 200 and may be connected to contacts 222 and other connections (not shown) to printed circuit board 220 through traces in printed circuit board 220. Devices and components 240 may be shielded by shield 250. Printed circuit board 220 may further include openings 226. Openings 226 may accept fasteners (not shown) that may be used to attach connector receptacle board 200 to a device enclosure (not shown).

In these and other embodiments of the present invention, printed circuit board 220 may be formed of various materials with a reduced concern for their wear or strength since printed circuit board 220 is reinforced with frame 230. This may allow the use of different or specialized materials for a higher-performing printed circuit board 220. Also, printed circuit board materials may be more freely selected for color, signal quality, aesthetics, availability, or other property.

Various connector tongues may need to meet various spacing requirements for its interface features to be compatible with their interface specifications. For example, the specifications for USB Type-C connector tongues may require specific locations and spacings for contacts 222 relative to outside features of connector tongue 210. The result is that printed circuit board 220, on which contacts 222 may be printed, may need to be accurately aligned in frame 230. Accordingly, embodiments of the present invention may provide features on various portions of connector tongue 210 to improve the alignment of frame 230 to printed circuit board 220. An example is shown in the following figure.

Figure 3:
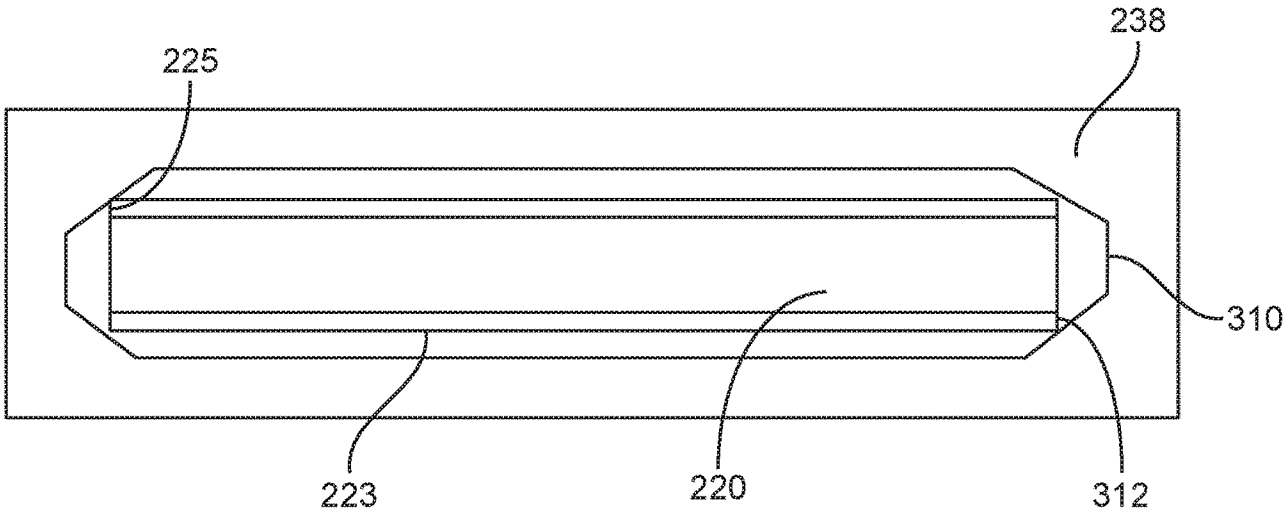
FIG. 3 illustrates a structure for aligning a printed circuit board to a frame according to an embodiment of the present invention.

FIG. 3 illustrates a structure for aligning a printed circuit board to a frame according to an embodiment of the present invention. In this example, flange 238 near a rear of frame 230 (shown in FIG. 2) may include passage 310 through which printed circuit board 220 may be inserted during assembly. Flange passage 310 may have angled corners 312 at each of its four corners for at least a part of its length (or depth, into the page). Printed circuit board 220 may have copper or other layers 223 on a top side and a bottom side. Copper layers 223 may engage angled corners 312 of passage 310 as printed circuit board 220 is inserted through passage 310 in flange 238. Copper layers 223 may be crushed at their corners 225, and the interference between the copper layers and the angled corners may act to center printed circuit board 220 to flange 238 and other portions of frame 230 as printed circuit board 220 is inserted. Put another way, copper layers 223 may act as crush-ribs to provide force to align printed circuit board 220 to frame 230. This technique may align printed circuit board 220 to frame 230 in the Y direction (laterally along the front of connector tongue 210) and the Z direction (in a direction orthogonal or normal to the top and bottom surfaces of connector tongue 210.

Figure 4:
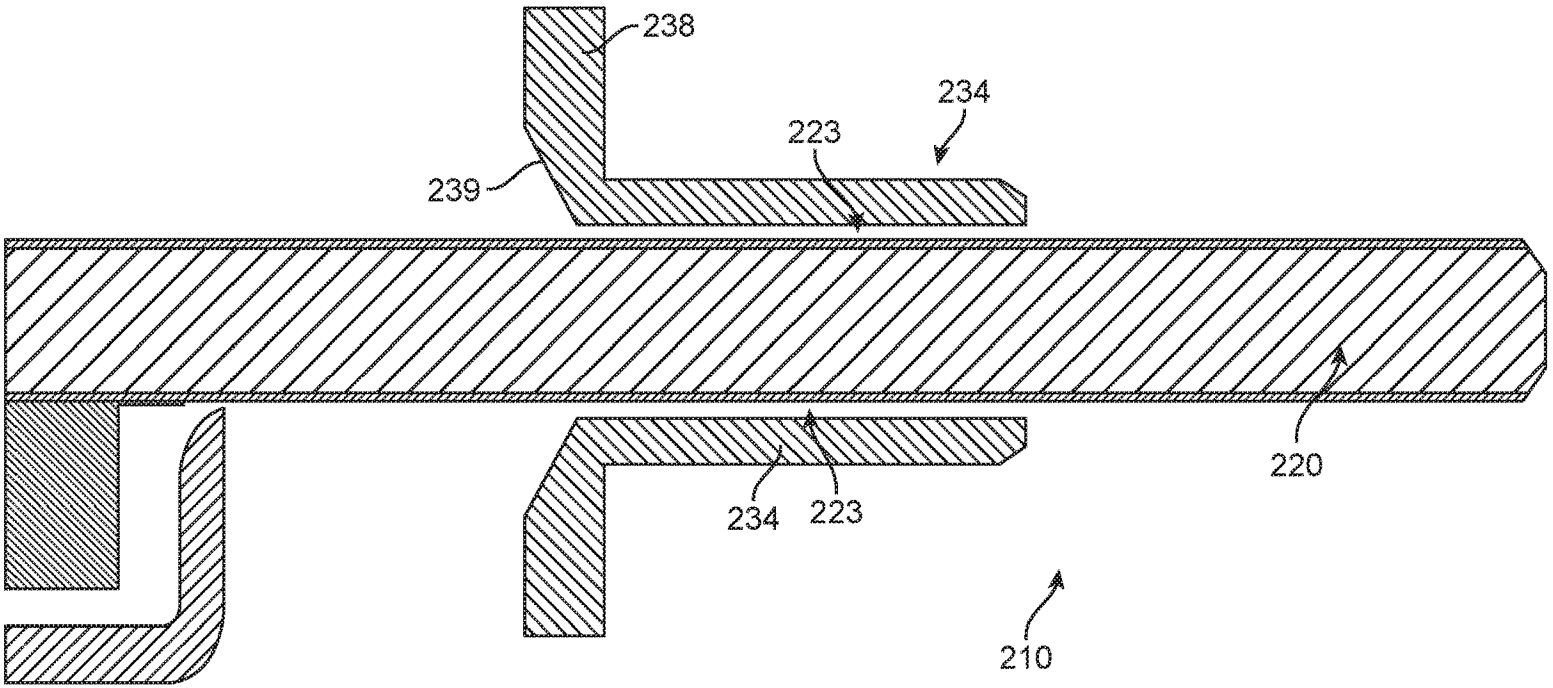
FIG. 4 illustrates a cutaway side view of a connector tongue according to an embodiment of the present invention.

FIG. 4 illustrates a cutaway side view of a connector tongue according to an embodiment of the present invention. Connector tongue 210 may include printed circuit board 220 having copper layers 223 on a top side and a bottom side. EMI plates 234 may be located on a top side and a bottom side of printed circuit board 220 as well. During assembly, printed circuit board 220 may be inserted into a rear of flange 238, which may have tapered lead-ins 239.

In these and other embodiments of the present invention, other techniques may be used to align printed circuit board 220 to frame 230. An example is shown in the following figures.

Figure 5:
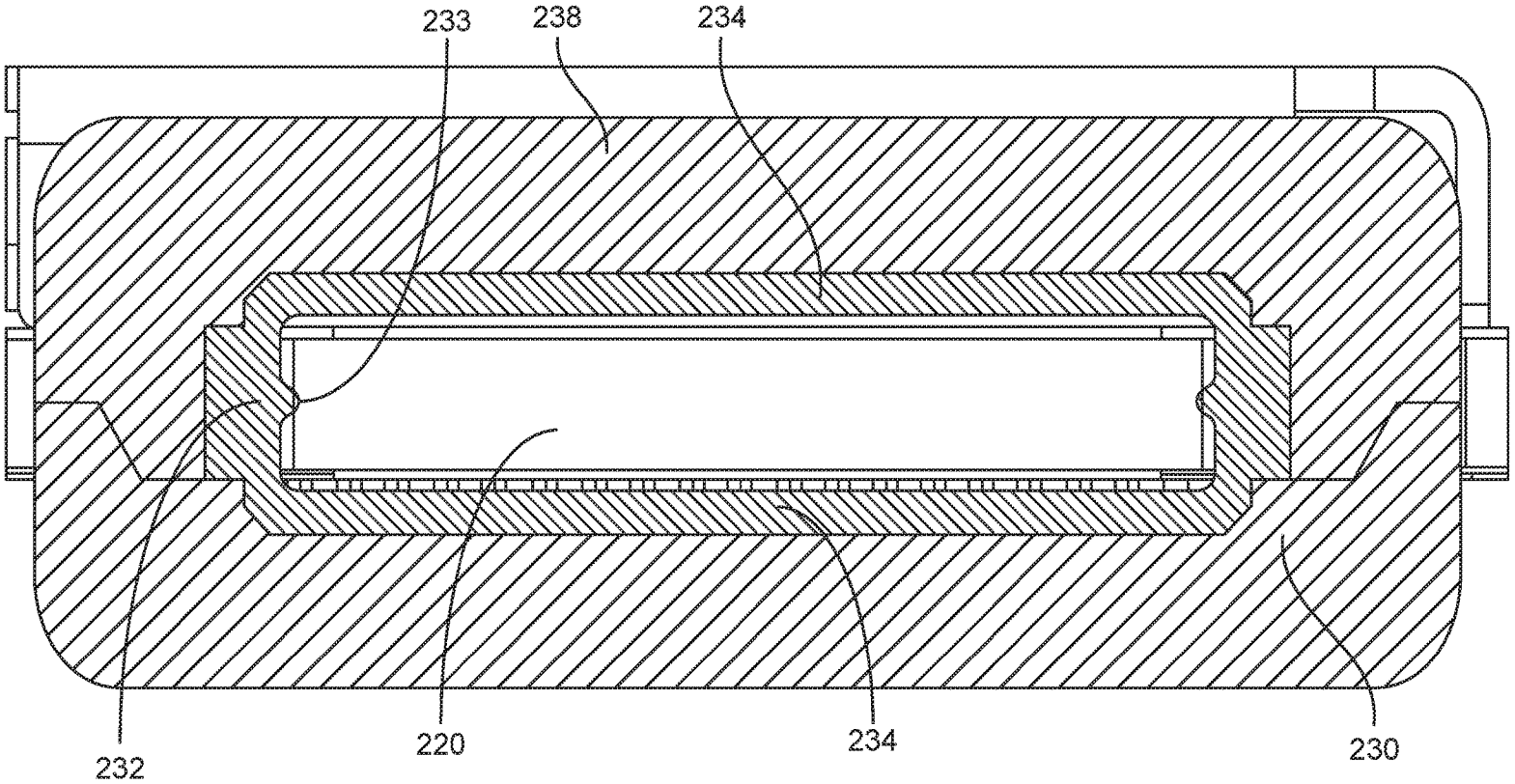
FIG. 5 illustrates a structure for aligning a printed circuit board to a frame according to an embodiment of the present invention.

FIG. 5 illustrates a structure for aligning a printed circuit board to a frame according to an embodiment of the present invention. An inside edge of each side retention feature 232 of frame 230 may include rib or nub for a portion of its length. Ribs or nubs on inside edges of side retention features may engage sides of printed circuit board 220 as printed circuit board 220 is inserted into frame 230. Ribs may push or cut into the sides of the softer printed circuit board 220. This force may act to center printed circuit board 220 to the side retention features and the other portions of frame 230 as printed circuit board 220 is inserted. The spacing of the ribs to the outside edges of the side retention features may be accurately controlled. This may improve the control of the position of the contacts on printed circuit board relative to the outside edges of side retention features.

Figure 6:
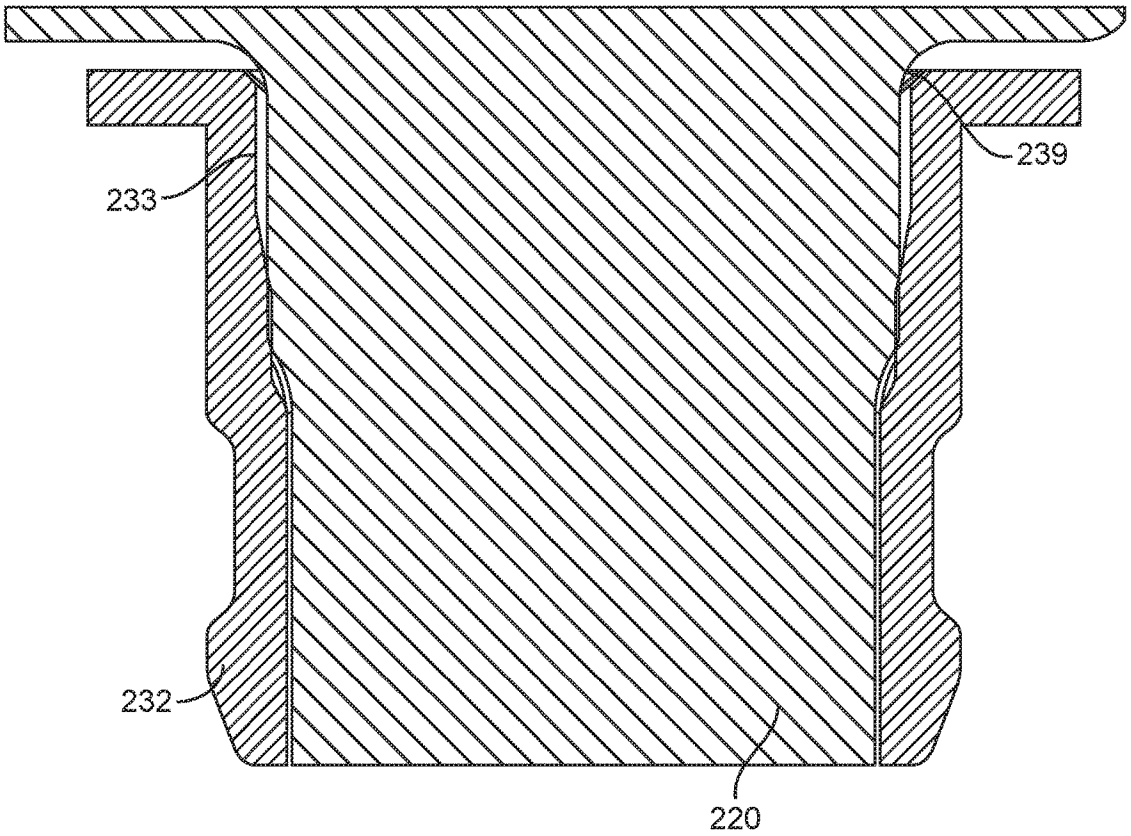
FIG. 6 is another view of the structure of FIG. 5 for aligning a printed circuit board to a frame.

FIG. 6 is another view of the structure of FIG. 5 for aligning a printed circuit board to a frame. Ribs or nubs 233 may extend along a portion of the interface between printed circuit board 220 and side retention features 232. Ribs or nubs on the inside edges of side retention features may engage sides of printed circuit board 220 as printed circuit board 220 is inserted into frame 230.

Connector tongue 210 may be used as a connector tongue in a connector receptacle. In this configuration, connector tongue 210 may be inserted into an opening in a device enclosure during device assembly. It may be desirable to provide features on connector tongue 210 to facilitate its alignment in the opening in the device enclosure. An example of one such feature is shown in the following figure.

Figure 7:
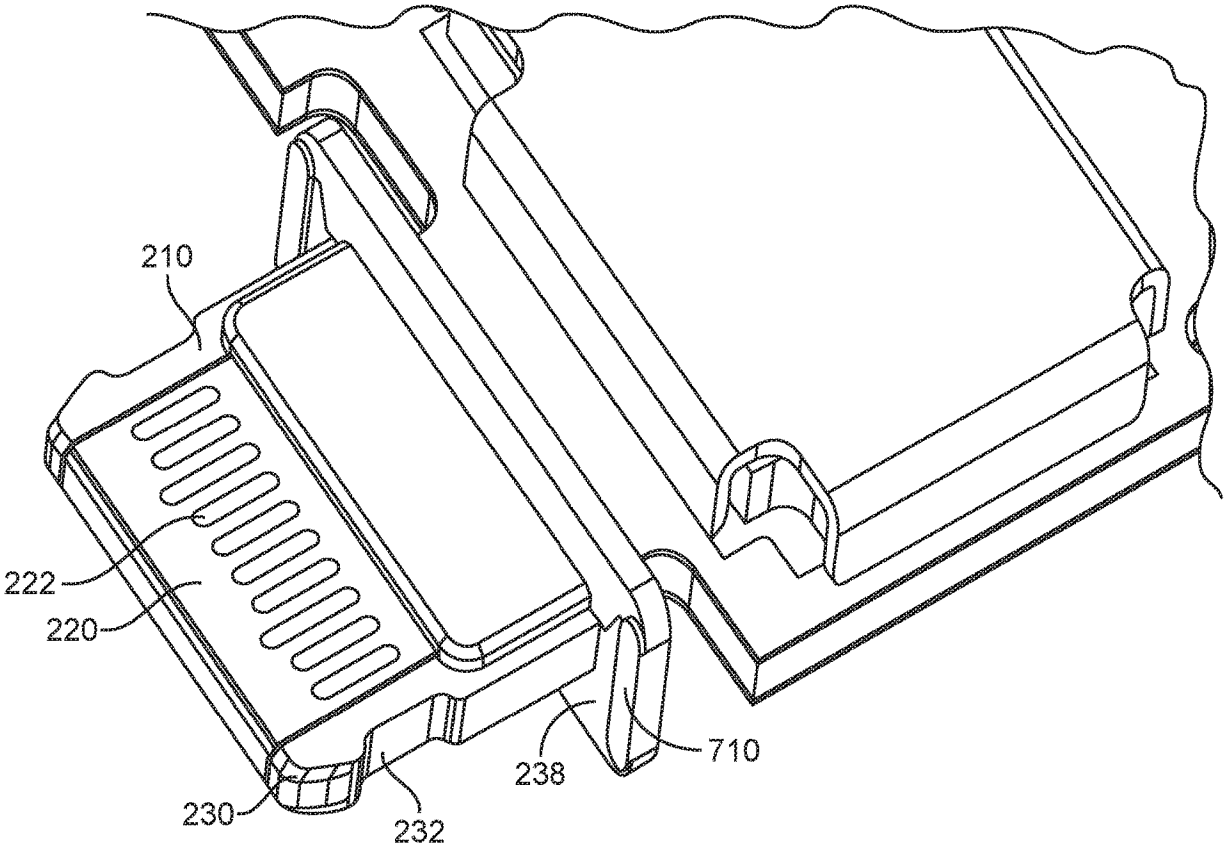
FIG. 7 illustrates a connector tongue according to an embodiment of the present invention.

FIG. 7 illustrates a connector tongue according to an embodiment of the present invention. In this example, standoffs 710 may be located on the front edge of flange 238 of frame 230. Standoffs may be used to align connector tongue 210 in an opening of a device enclosure (not shown). Standoffs may be attached to, or formed as part of, a front of flange 238 of frame 230. These standoffs may provide space for a conductive foam (not shown) to be placed between the front surface of flange 238 of frame 230 and an inside surface (not shown) of the device enclosure to provide ground paths from frame 230 to the device enclosure. Printed circuit board 220 may incorporate a number of contacts 222.

Figure 8:
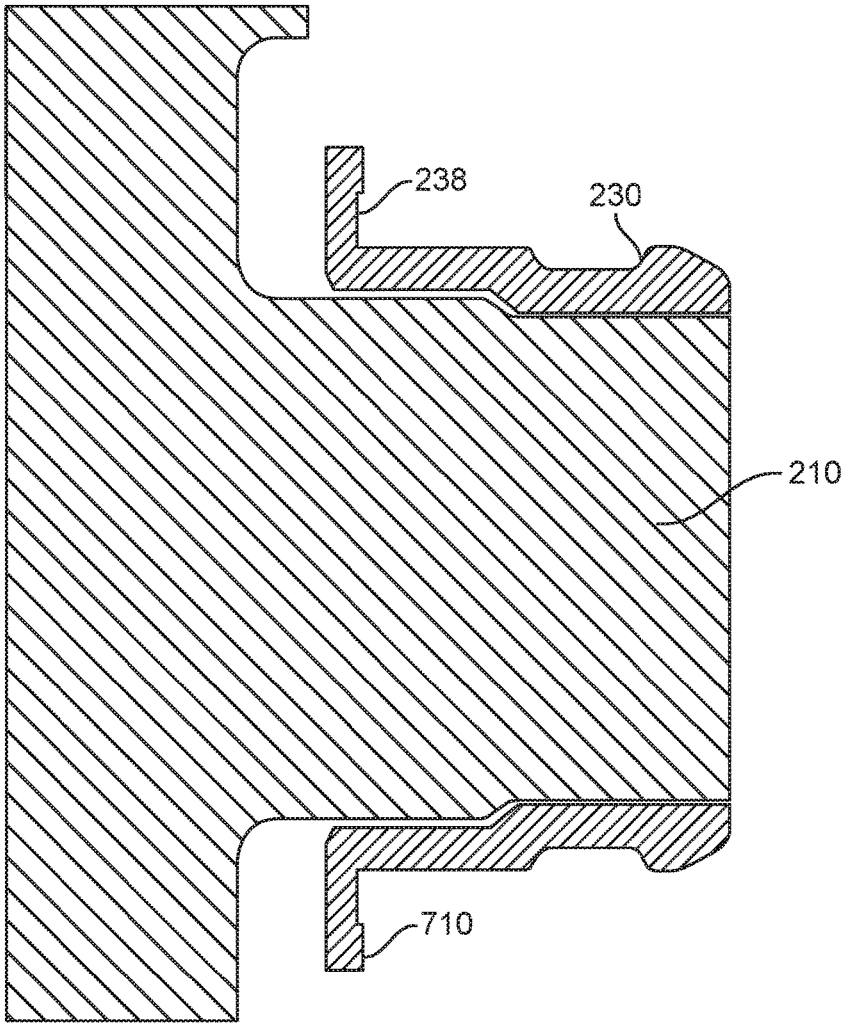
FIG. 8 illustrates a top view of the connector tongue of FIG. 7.

FIG. 8 illustrates a top view of the connector tongue of FIG. 7. Standoffs 710 may be attached to, or formed as part of, a front of flange 238 of frame 230. Standoffs 710 may be used to align connector tongue 210 to an opening of a device enclosure (not shown).

Connector tongues 210 may be used in connector receptacles. A recess or opening in a device enclosure (not shown) may form a housing or opening for the connector receptacle, into which connector tongue 210 may be inserted. Accordingly, embodiments of the present invention may provide apparatus and methods for assembling and aligning connector tongue 210 to an opening in a device enclosure. These and other embodiments of the present invention may provide apparatus and methods that combine an insertion and an alignment of printed circuit board 220 into frame 230 of connector tongue 210 with an insertion and alignment of connector tongue 210 into an opening in a device enclosure. Examples are shown in the following figures.

Figure 9:
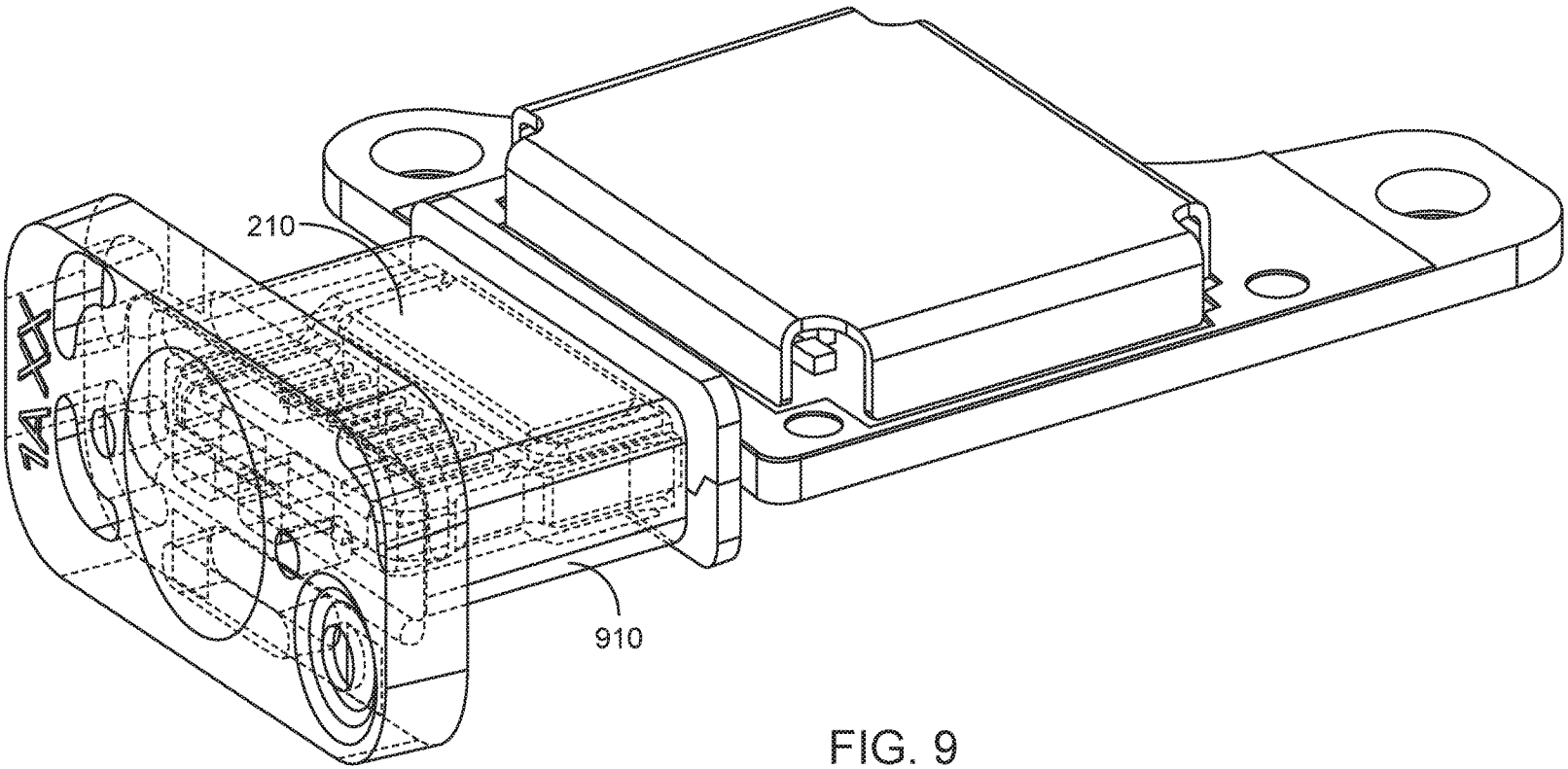
FIG. 9 illustrates a reflow cap and a connector receptacle board according to an embodiment of the present invention.

FIG. 9 illustrates a reflow cap and a connector receptacle board according to an embodiment of the present invention. Reflow cap 910 may fit in an opening in a device enclosure (not shown). During assembly, reflow cap 910 and connector tongue 210 may be inserted from opposite sides into the device enclosure (not shown), in order to provide Y- and Z-alignment of the tongue 210 to the device enclosure.

Figure 10:
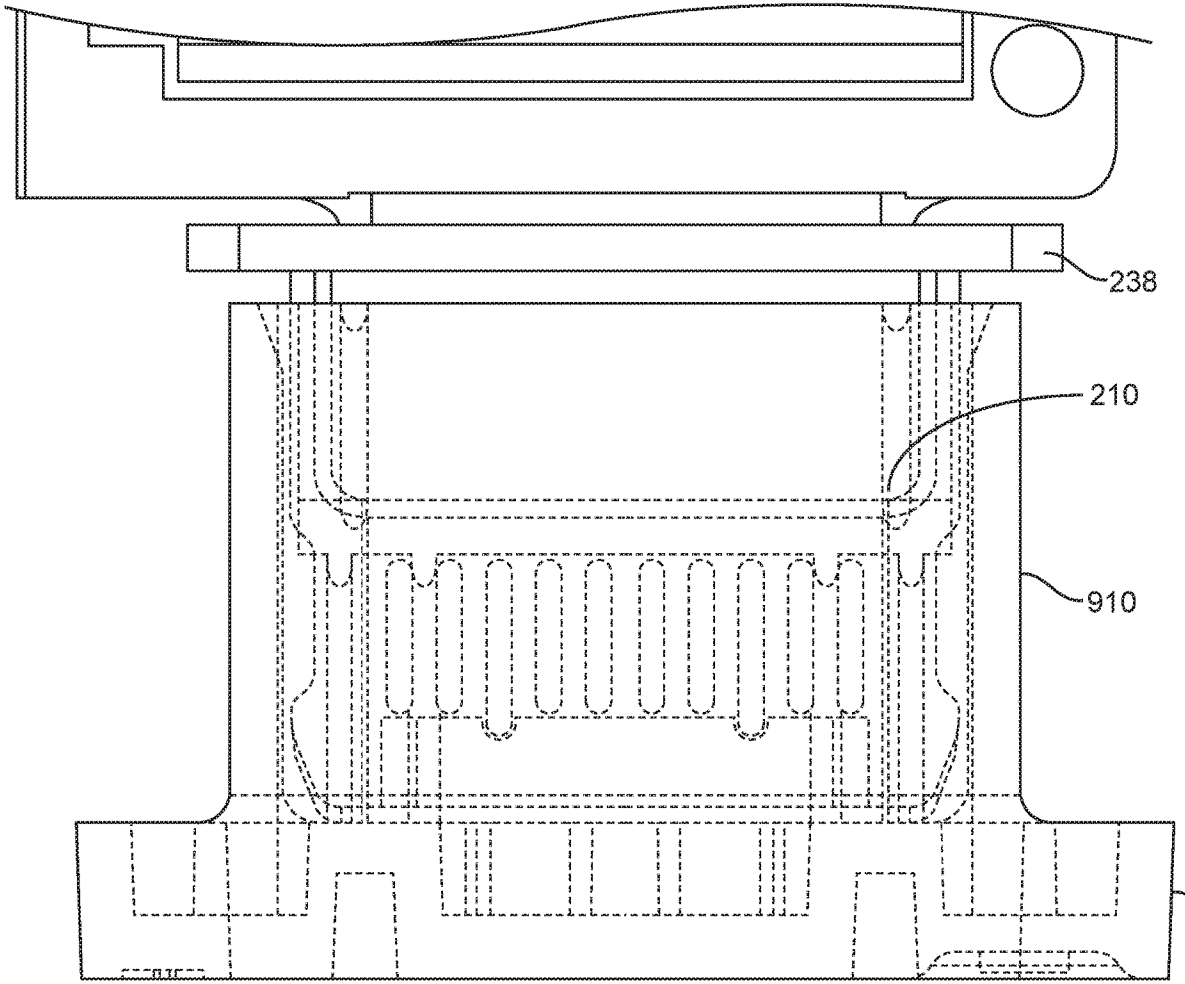
FIG. 10 illustrates a top view of a reflow cap and a connector tongue according to an embodiment of the present invention.

FIG. 10 illustrates a top view of a reflow cap and a connector tongue according to an embodiment of the present invention. Reflow cap 910 may have a wide portion 912 having an outer surface that fits into an opening of a device enclosure (not shown). Crush ribs (not shown) on an outside surface of reflow cap 910 may accurately position reflow cap 910 in the opening in the device enclosure. The connector tongue 210 may be inserted to a depth where a front edge of flange 238 may be against an inside edge (not shown) of the device enclosure, whereas reflow cap 910 may be inserted from the opposite side of the device enclosure to provide Y- and Z-alignment of the tongue 210 to the opening of the device enclosure.

Figure 11:
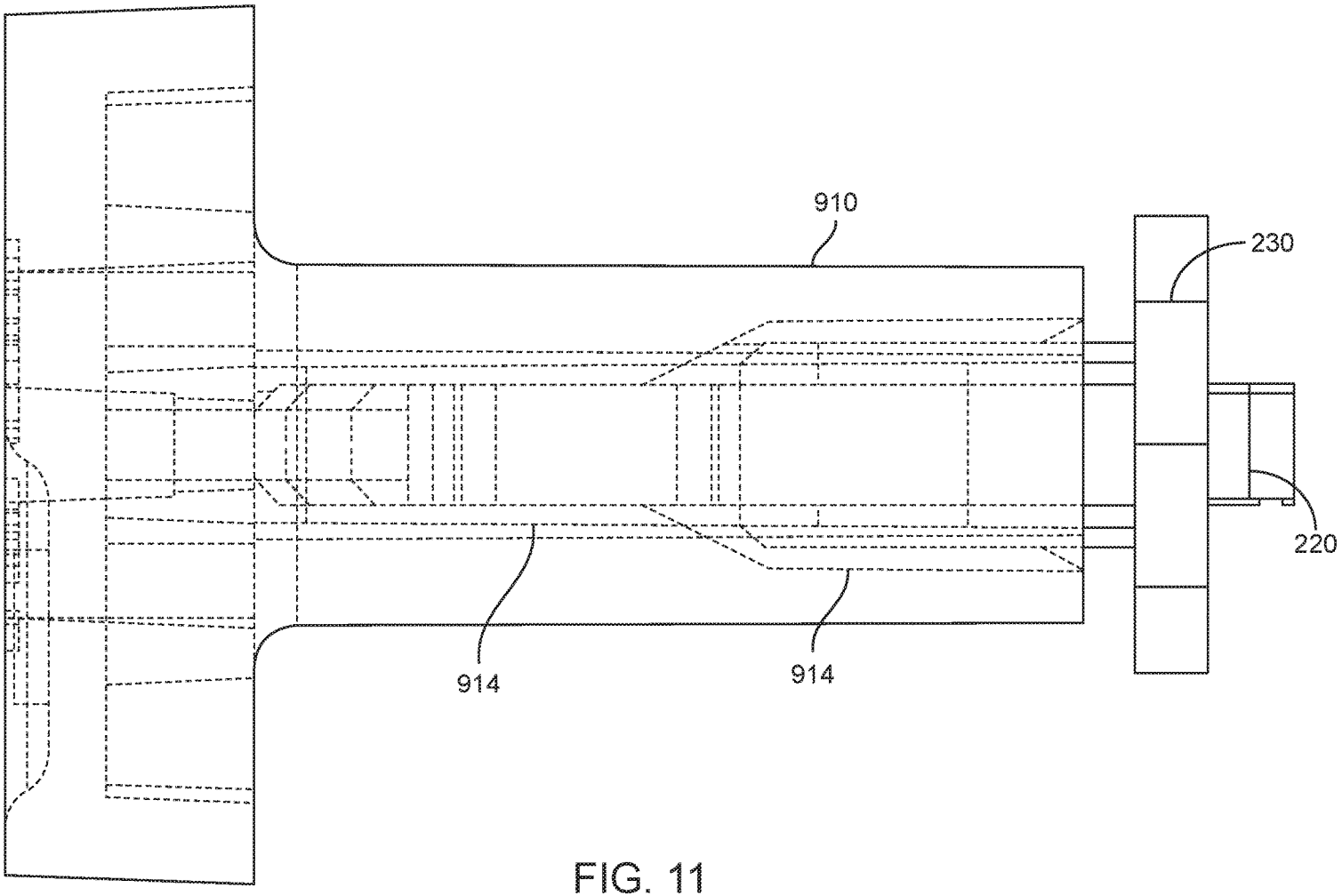
FIG. 11 illustrates a side view of a reflow cap and a connector tongue according to an embodiment of the present invention.

FIG. 11 illustrates a side view of a reflow cap 910 and a connector tongue according to an embodiment of the present invention. In this example, crush ribs 914 on an inside surface of reflow cap 910 may help to accurately position frame 230 to reflow cap 910 and therefor to the device enclosure opening (not shown). After the combined reflow cap 910 and frame 230 are put in place, printed circuit board 220 may be inserted into frame 230 while frame 230 is held in place by reflow cap 910. Reflow cap 910 may in turn be held in place by a press-in tool (not shown). Printed circuit board 220 may be inserted into frame 230 until an inside end surface of reflow cap 910 is reached.

After insertion into frame 230, printed circuit board 220 may be fixed to frame 230, and frame 230 may be fixed to the device enclosure or other structure associated with the device enclosure (not shown). Reflow cap 910 may remain installed during assembly and shipping to protect connector tongue 210 from damage by physical contact and discoloration from overheating, though it may be removed at some time before or after this. After removal, reflow cap 910 may be recycled. In these examples, ribs or nubs 233 on side retention features 232 (shown in FIG. 5) may align printed circuit board 220 to frame 230 in the Y direction (laterally along the front of the connector tongue 210), while reflow cap 910 may align printed circuit board 220 to frame 230 in the Z direction (a direction orthogonal or normal to the top and bottom surfaces of the connector tongue 210 and the X direction (the direction of insertion of printed circuit board 220 into the frame 230.) Accurate positioning in the Z direction may facilitate the positioning of EMI plates 234 of frame 230 relative to surfaces of printed circuit board 220.

Figure 12:
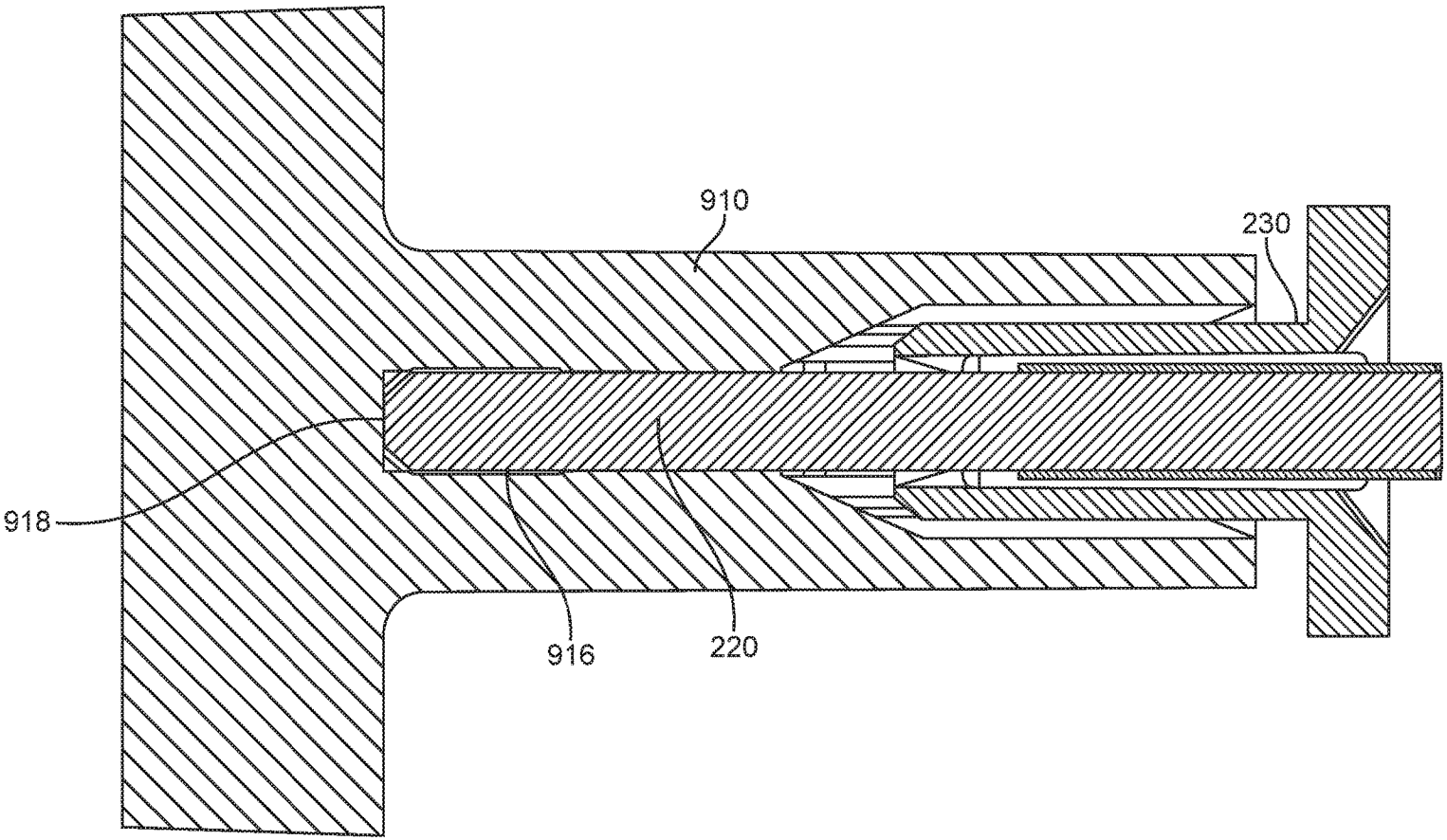
FIG. 12 illustrates a cutaway side view of a reflow cap and a connector tongue according to an embodiment of the present invention.

FIG. 12 illustrates a cutaway side view of a reflow cap 910 and a connector tongue according to an embodiment of the present invention. Printed circuit board 220 may be inserted in frame 230 until it reaches end surface 918 of an inside of reflow cap 910. Additional crush ribs 916 on an inside surface of reflow cap 910 may position printed circuit board 220 relative to frame 230 in the Z direction, such that gaps between printed circuit board 220 and frame 230 are maintained to provide space for solder to flow during solder reflow. Crush ribs 916 may also form interstitial walls that align and position contacts 222 of printed circuit board 220 relative to frame 230 in the Y direction.

Another example of a connector tongue that may be used in a connector receptacle is shown in the following figure.

Figure 13:
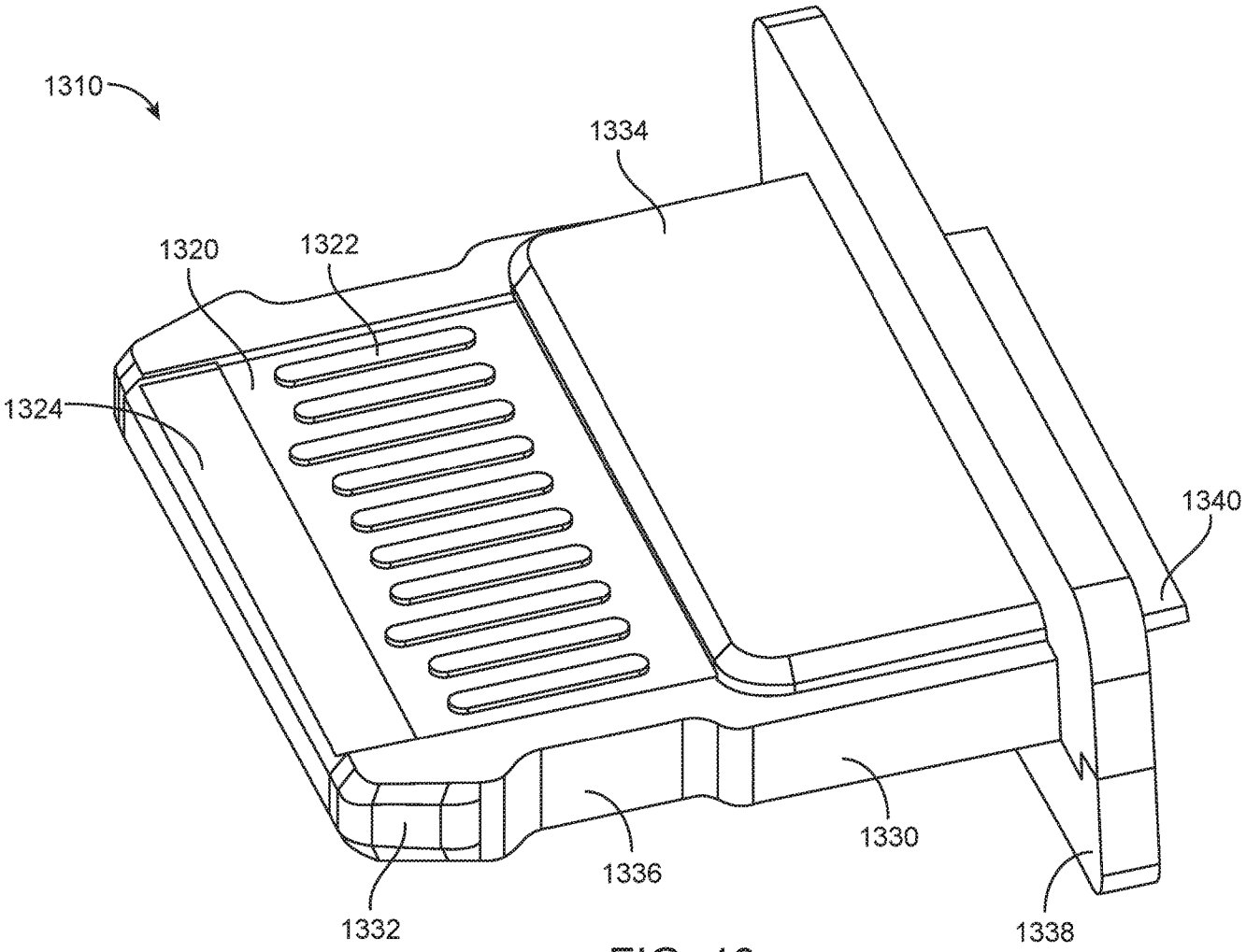
FIG. 13 illustrates a connector receptacle tongue according to an embodiment of the present invention.

FIG. 13 illustrates a connector receptacle tongue according to an embodiment of the present invention. Connector tongue 1310 may be formed of one or more printed circuit boards, including printed circuit board 1320, one each side of flexible circuit board 1340, the three board in frame 1330. Printed circuit board 1320 may incorporate contacts 1322 on a top side, while a second printed circuit board 1321 (shown in FIG. 14) may incorporate contacts (not shown) on a bottom side. Printed circuit board 1320 may provide pathways (not shown) through connector tongue 1310 to flexible circuit board 1340. This configuration may provide low impedances for power traces (not shown), matched impedances for differential signal pairs (not shown), and shielding for both. Printed circuit board 1320 may provide a connector tongue 1310 that may provide a high signal quality or signal integrity to allow high speed data transfers. The combination of printed circuit boards 1320 and 1321 with flexible circuit board 1340 may provide a highly flexible routing structure.

Connector tongue 1310 may further include frame 1330. Frame 1330 may provide a connector tongue that is durable, has good wear performance, and provides a constant level of performance. Frame 1330 may include side retention features 1332 on each lateral side of printed circuit board 1320, where the lateral sides are between the top and bottom sides of printed circuit board 1320. Side retention features 1332 may form a portion of frame 1330 that extend along sides of connector tongue 1310. Side retention features 1332 may be joined near a rear of the connector tongue by flange 1338. When the connector tongue is used in a USB Type-C connector receptacle, EMI plates 1334 may extend along a top and bottom of the connector tongue 1310 joining side retention features 1332 on a top and bottom of connector tongue 1310.

In these and other embodiments of the present invention, a front cross-beam 1324 may join side retention features 1332 together. The front cross-beam 1324 may be covered in plastic to reduce wear on corresponding connectors that are mated with the connector tongue. This plastic may be an overmold that may prevent contacts on a corresponding connector (not shown) from being shorted or grounded by the front cross-beam 1324 when the corresponding connector is mated with connector tongue 1310. Whether a front of connector tongue 1310 is formed of printed circuit board 1320 or plastic covering a front cross-beam 1324 of connector tongue 1310 may be chamfered to simplify mating to a corresponding connector. Front cross-beam 1324 of connector tongue 1310 may be pad printed, the plastic may be dyed, or other steps may be taken to improve its cosmetic appearance. Where part of front cross-beam 1324 of connector tongue 1310 is formed by printed circuit board 1320 and another part of front cross-beam 1324 of the connector tongue 1310 is formed by frame 1330, different techniques and steps may be needed for each part. These different steps may be arranged such that printed circuit board 1320 and frame 1330 look similar, or they may have contrasting appearances.

In these and other embodiments of the present invention, frame 1330 may be metallic or ceramic, it may be metallic coated with a ceramic, or it may be formed of other material. Frame 1330 may increase a strength of connector tongue 1310 as compared to a connector tongue formed only of printed circuit board 1320. Frame 1330 may have good wear performance. A metal frame 1330 may be oxidized or coated with a ceramic or other material for increased lubricity for even better wear performance, and to insulate it electrically where necessary. This oxidation or coating may be selective such that portions, such as EMI plates 1334 and notches 1336 of side retention features 1332, are not oxidized or coated such that they may make electrical contact with corresponding features on a corresponding connector (not shown) when the corresponding connector is mated with connector tongue 1310. Specifically, EMI plates 1334 may be exposed such that they may make electrical contact with ground contacts (not shown) near a front of a USB Type-C connector insert (not shown). Notches 1336 may be exposed such that they make electrical contact with side retention springs in sides of an opening in a USB Type-C connector insert. In these and embodiments of the present invention, the coating or oxidation may be done using physical vapor deposition (PVD), ion injection, or other process technique. In one example, a titanium frame 1330 may be at least partially oxidized to form titanium-oxide on at least a part of the surface of frame 1330. The use of these materials for side retention features 1332 of frame 1330 may also provide a clear tactile and audible response to a user when a user mates a connector having connector tongue 1310 with a corresponding connector, as compared to a plastic or printed circuit board tongue without side retention features 1332.

In various embodiments of the present invention, frame 1330 may be made in different ways. For example, frame 1330 may be formed using metal-injection molding, 3-D printing, forging, stamping, or other process. Printed circuit board 1320 may be made using various techniques. Printed circuit board 1320 may be a multilayer board and it may have a central ground plane or other ground planes (not shown). Printed circuit board 1320 may be a multilayer printed circuit board comprising a plurality of traces (not shown) on each of a plurality of layers (not shown), and further comprising a plurality of vias (not shown) each connecting two traces on different layers in the plurality of layers to each other. Printed circuit board 1320 may include multiple layers supporting traces and planes (not shown) and may further include vias for connecting traces and planes on different layers to each other. Ground connections (not shown) may be made from a ground plane (not shown) in printed circuit board 1320 or flexible circuit board 1340 to frame 1330. For example, one or more vias (not shown) may connect the ground plane to a top surface of printed circuit board 1320 adjacent to EMI plate 1334. EMI plates 1334 may then be connected to the ground plane in printed circuit board 1320. In these and other embodiments of the present invention, the ground plane may extend to a side of printed circuit board 1320. The side of printed circuit board 1320 may be edge plated, where the edge plating (not shown) connects to the ground plane. The edge plating may then be electrically connected to side retention features 1332 to form a ground path.

Figure 15:
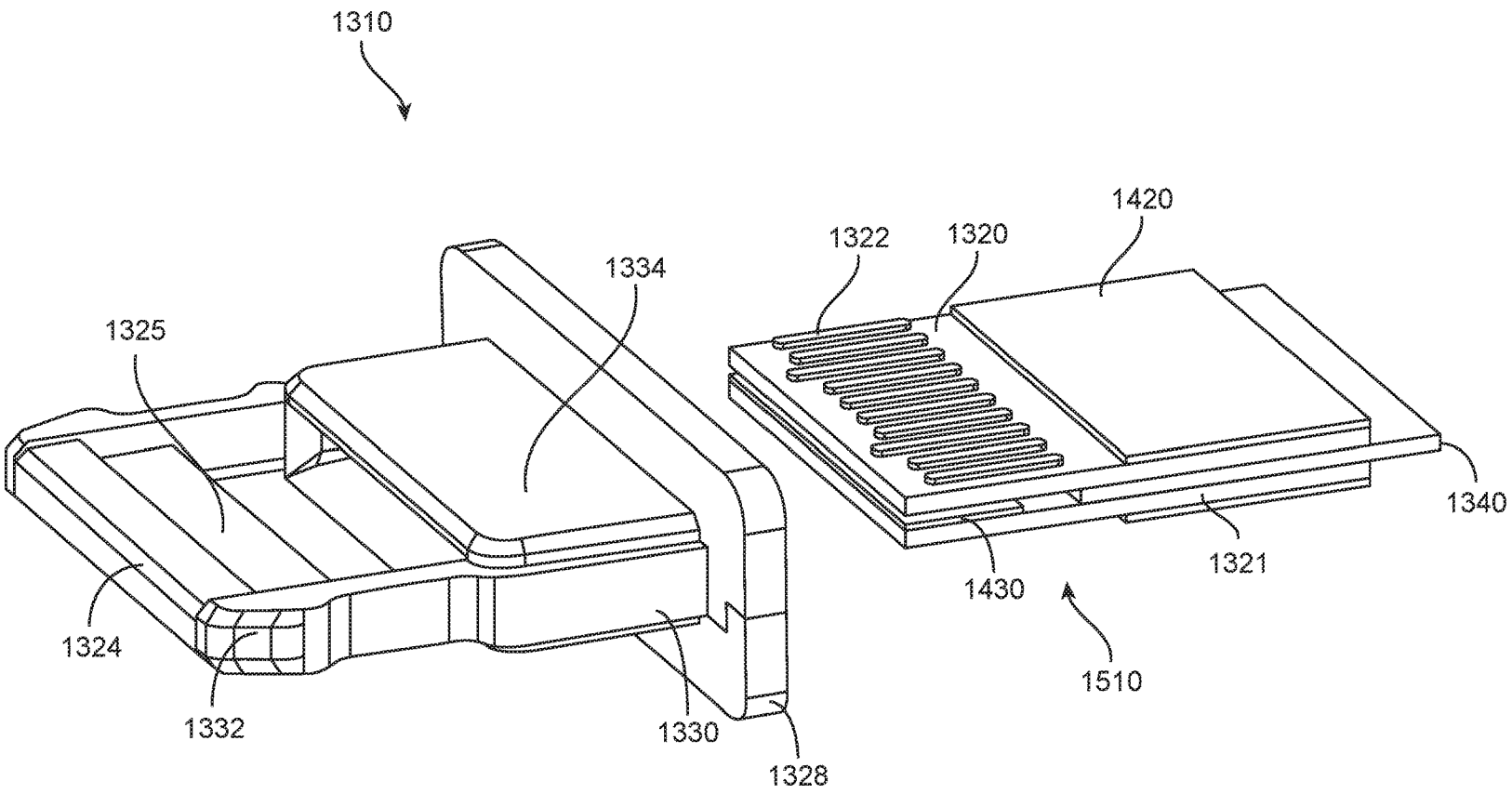
FIG. 15 illustrates a partially exploded view of the receptacle tongue of FIG. 13.

In these and other embodiments of the present invention, frame 1330 may strengthen and increase the durability of connector tongue 1310. Portions of frame 1330 may be soldered to printed circuit boards 1320 and 1321 to further strengthen connector tongue 1310. For example, adjoining sides of printed circuit board 1320 and side retention features 1332 may be soldered together. The area between EMI plates 1334 and a top and bottom of printed circuit board 1320 may be soldered, thereby greatly increasing the strength of connector tongue 1310. Solder paste may be applied to surfaces of printed circuit board 1320. After printed circuit boards 1320 and 1321, and flexible circuit board 1340 are pushed into frame 1330 (as shown in FIG. 15), the solder paste may be heated and the solder may connect these surfaces. Capillary action may cause the solder paste to flow and fill gaps between printed circuit boards 1320 and 1321 and frame 1330.

In these and other embodiments of the present invention, printed circuit board 1320 may be formed of various materials with a reduced concern for their wear or strength since printed circuit board 1320 is reinforced with frame 1330. This may allow the use of different or specialized materials for a higher-performing printed circuit board 1320. Also, printed circuit board materials may be more freely selected for color, signal quality, aesthetics, availability, or other property.

In this example, cross-beam 1324 may be covered or overmolded with plastic or other wear-reducing material. In these and other embodiments of the present invention, cross-beam 1324 may be formed of a center conductive region, which may be grounded to either or both printed circuit boards 1320 and 1321. The center conductive region may then be overmolded with plastic. An example is shown in the following figures.

Figure 14:
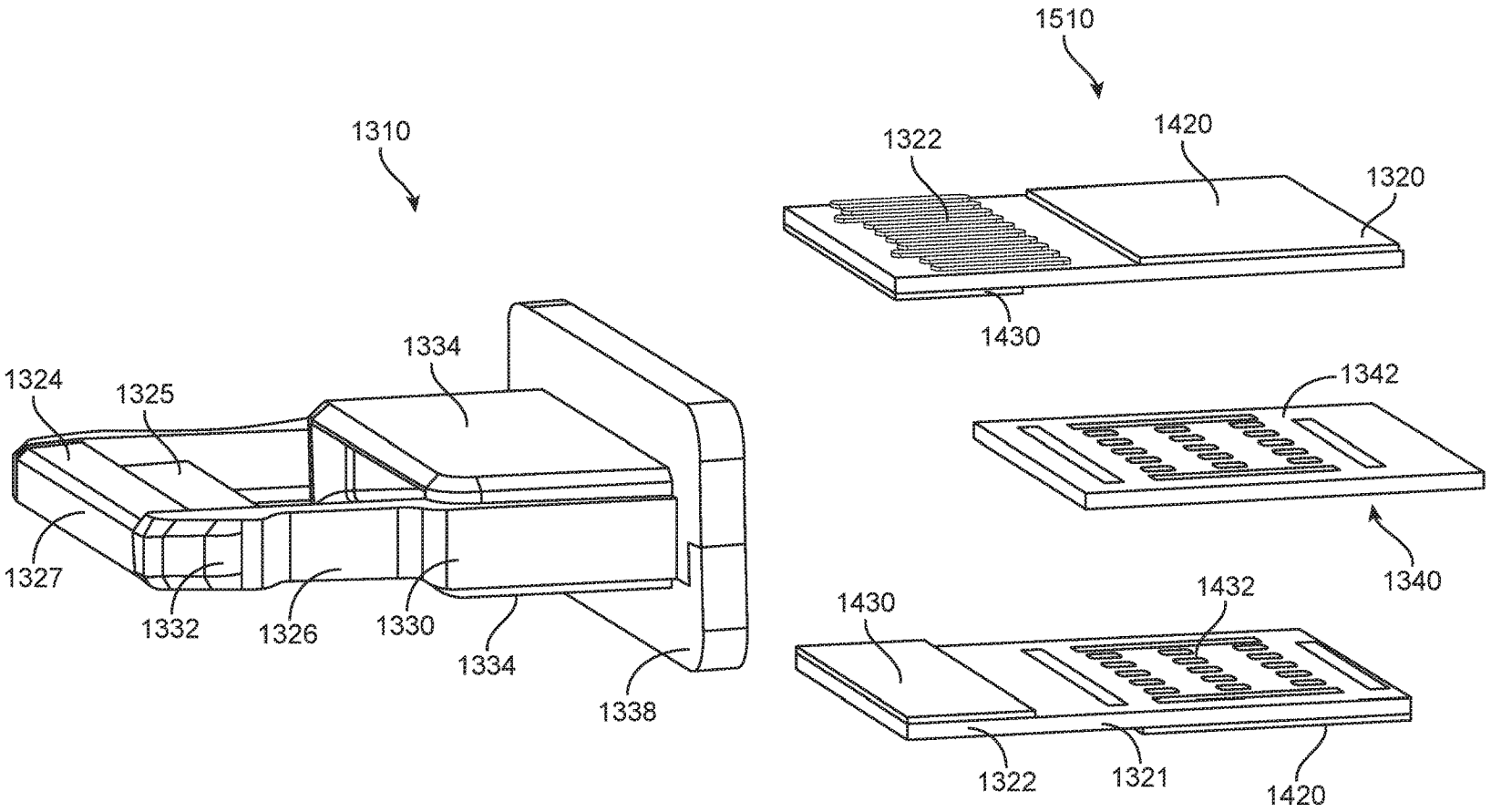
FIG. 14 illustrates an exploded view of the receptacle tongue of FIG. 13.

FIG. 14 illustrates an exploded view of the receptacle tongue of FIG. 13. Frame 1330 may include side retention features 1332, which may be attached to flange 1338. Side retention features 1332 may be connected together through cross-beam 1324. Cross-beam 1324 may include bridge 1325 and overmold portion 1327. Side retention features 1332 may include notches 1326 for electrically connecting to side ground contacts (not shown) of a connector insert (not shown) when the connector insert is inserted into a connector receptacle housing connector tongue 1310.

Top printed circuit board 1320 may incorporate contacts 1322 and ground region 1420 on a top side. Bottom printed circuit board 1321 may include contacts 1322 and ground region 1420 on a bottom side. Bottom printed circuit board 1321 may have contacts 1432 and ground region 1430 on a top side. Top printed circuit board 1320 may include similar contacts 1432 (not shown) and ground region 1430 on an underside. Contacts 1432 may connect to contacts 1322 in top printed circuit board 1320 and bottom printed circuit board 1321 via traces in those boards (not shown.) Flexible circuit board 1340 may include contacts 1342 on a top and bottom side. Contacts 1342 may electrically connect to contacts 1432 on a top side of bottom printed circuit board 1321 and similar contacts (not shown) on a bottom side of top printed circuit board 1320. Flexible circuit board may provide paths for contacts 1322 to electrically connect to circuits and components elsewhere in an electronic device housing a connector receptacle that includes connector tongue 1310.

During assembly, contacts 1432 on the underside of top printed circuit board 1320 may be electrically connected to contacts 1342 on a top side of flexible circuit board 1340. Similarly, contacts 1432 on a top side of bottom printed circuit board 1321 may electrically connect to contacts 1342 (not shown) on the underside of flexible circuit board 1340.

The combined stack 1510 of top printed circuit board 1320, intermediate flexible circuit board 1340, and bottom printed circuit board 1321 may then be inserted into frame 1330. Ground regions 1430 on the bottom side of top printed circuit board 1320 and top side of bottom printed circuit board 1321 may be soldered or otherwise attached to bridge 1325. Ground regions 1420 on a top side of top printed circuit board 1320 and a bottom side of bottom printed circuit board 1321 may be soldered or otherwise attached to EMI plates 1334 on a top and bottom side of connector tongue 1310.

FIG. 15 illustrates a partially exploded view of the receptacle tongue of FIG. 13. In this example, a stack 1510 including top printed circuit board 1320, intermediate flexible circuit board 1340, and bottom printed circuit board 1321 may be assembled. This assembly may then be slid into place in frame 1330. Ground regions 1430 on a bottom side of top printed circuit board 1320 and a top side of bottom printed circuit board 1321 may be soldered or otherwise attached to bridge 1325. Similarly, ground regions 1420 on a top side of top printed circuit board 1320 and a bottom side of bottom printed circuit board 1321 may be attached to EMI plates 1334 on a top and bottom of connector tongue 1310. Contacts 1322 may be located in an open area between cross-beam 1324 and EMI plates 1334 on connector tongue 1310. Contacts 1322 may contact corresponding contacts in a connector insert when the connector insert is inserted into a connector receptacle that includes connector tongue 1310.

Figure 16:
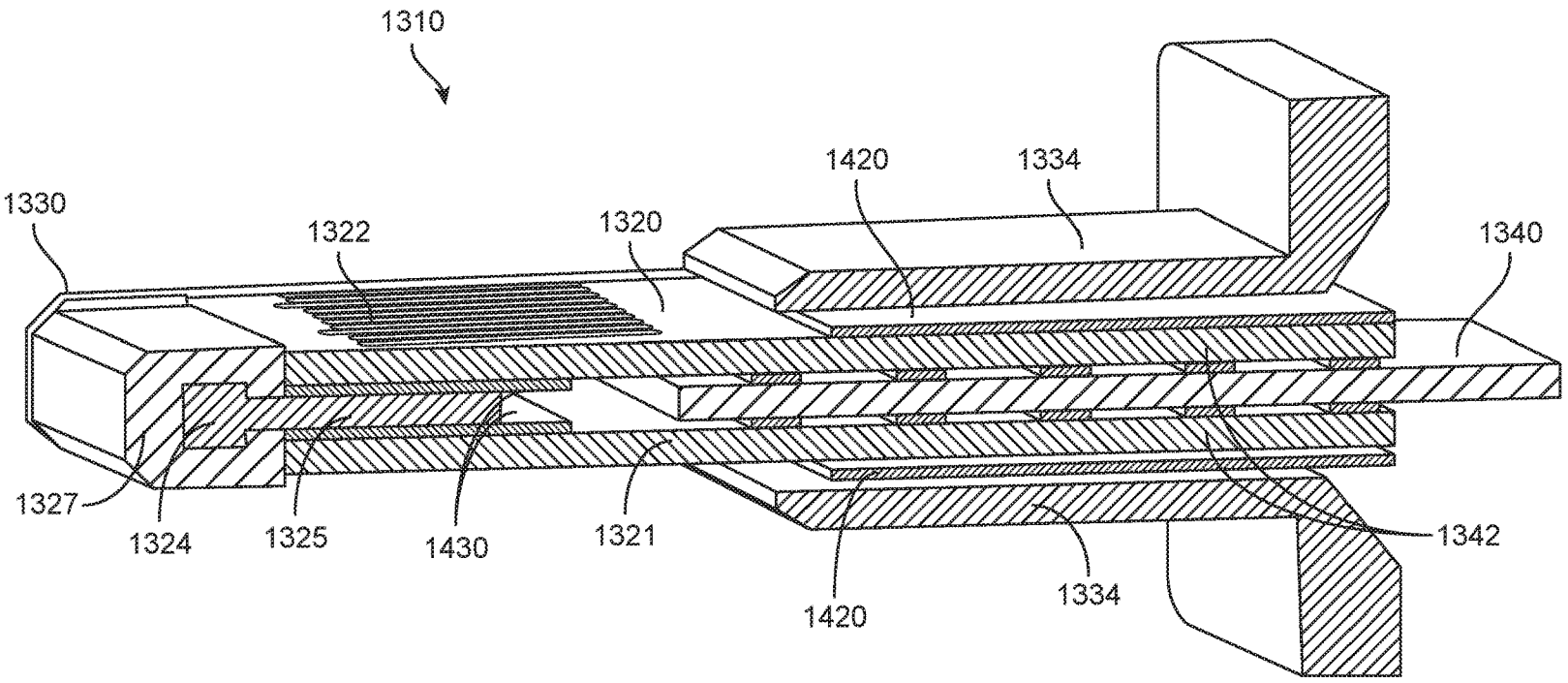
FIG. 16 illustrates a cutaway side view of the receptacle tongue of FIG. 13.

FIG. 16 illustrates a cutaway side view of the receptacle tongue of FIG. 13. In this example, top printed circuit board 1320, intermediate flexible circuit board 1340, and bottom printed circuit board 1321 have been inserted into frame 1330. Frame 1330 may include cross-beam 1324 which may include bridge 1325. Cross-beam 1324 may be encapsulated by overmold portion 1327. Ground regions 1430 on a bottom side of top printed circuit board 1320 and a top side of bottom printed circuit board 1321 may be soldered to or otherwise attached to bridge 1325. Ground regions 1420 on a top side of top printed circuit board 1320 and a bottom side of bottom printed circuit board 1321 may be soldered or otherwise attached to EMI plates 1334. Contacts 1342 may form electrical connections with contacts 1432 (shown in FIG. 14) on a bottom side of top printed circuit board 3020 and a top side of bottom printed circuit board 1321. These contacts may be connected to contacts 1322 on a top and bottom of connector tongue 1310 via one or more traces (not shown.) Contacts 1342 may also connect to traces in flexible circuit board 1340. Flexible circuit board 1340 may route signal lines from contacts 1322 to other circuits and components in an electronic device housing connector tongue 1310.

An example of another connector tongue that may be used in a connector receptacle is shown in the following figure.

Figure 17:
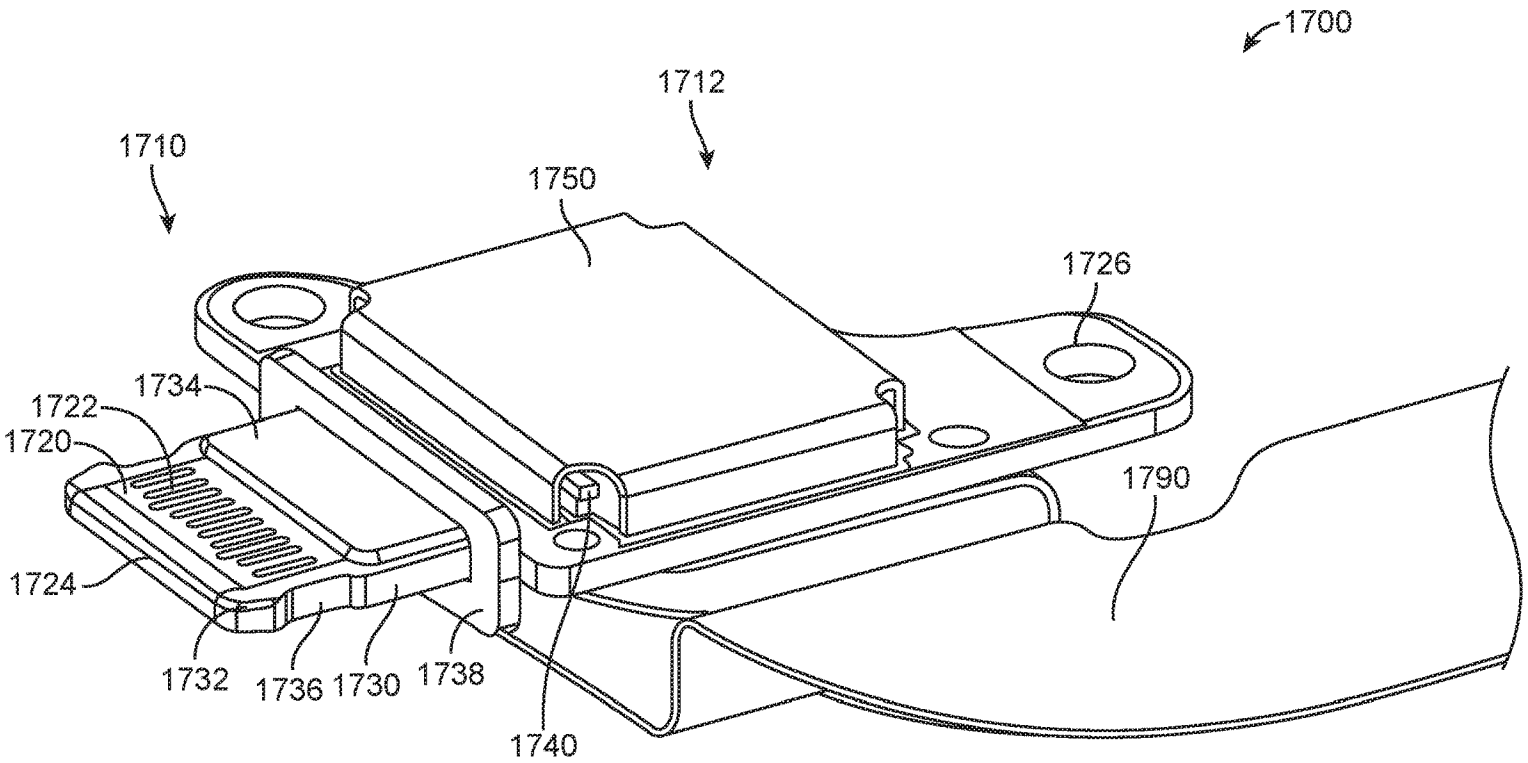
FIG. 17 illustrates a connector receptacle board having a connector tongue according to an embodiment of the present invention.

FIG. 17 illustrates a connector receptacle board having a connector tongue according to an embodiment of the present invention. Connector receptacle board 1700 may include a connector tongue 1710 and a rear portion 1712. Connector tongue 1710 may be formed of a printed circuit board 1720 and frame 1730. Printed circuit board 1720 may incorporate contacts 1722 on a top side, a bottom side, or both sides of printed circuit board 1720. Printed circuit board 1720 may provide pathways (not shown) through connector tongue 1710 (and the remaining rear portion 1712 of connector receptacle board 1700) that may provide low impedances for power traces (not shown), matched impedances for differential signal pairs (not shown), and shielding for both. Printed circuit board 1720 may provide a connector tongue 1710 that may provide a high signal quality or signal integrity to allow high speed data transfers.

Connector tongue 1710 may further include frame 1730. Frame 1730 may provide a connector tongue that is durable, has good wear performance, and provides a constant level of performance. Frame 1730 may include side retention features 1732 on each lateral side of printed circuit board 1720, where the lateral sides are between the top and bottom sides of printed circuit board 1720. Side retention features 1732 may form a portion of frame 1730 that extend along sides of connector tongue 1710. Side retention features 1732 may be joined near a rear of the connector tongue by flange 1738. When the connector tongue is used in a USB Type-C connector receptacle, EMI plates 1734 may extend along a top and bottom of the connector tongue 1710 joining side retention features 1732 on a top and bottom of connector tongue 1710.

In these and other embodiments of the present invention, a front cross-beam (not shown) at or near a front of cross-beam 1724 of connector tongue 1710 may join side retention features 1732 together. The front cross-beam may be covered in plastic (not shown) to reduce wear on corresponding connectors that are mated with the connector tongue. This plastic may be an overmold that may prevent contacts on a corresponding connector (not shown) from being shorted or grounded by the front cross-beam when the corresponding connector is mated with connector tongue 1710. Whether a front of connector tongue 1710 is formed of printed circuit board 1720 or plastic covering a front cross-beam, front of cross-beam 1724 of connector tongue 1710 may be chamfered to simplify mating to a corresponding connector. Front of cross-beam 1724 of connector tongue 1710 may be pad printed, the plastic may be dyed, or other steps may be taken to improve its cosmetic appearance. Where part of front of cross-beam 1724 of connector tongue 1710 is formed by printed circuit board 1720 and another part of front of cross-beam 1724 of the connector tongue 1710 is formed by frame 1730, different techniques and steps may be needed for each part. These different steps may be arranged such that printed circuit board 1720 and frame 1730 look similar, or they may have contrasting appearances.

In these and other embodiments of the present invention, frame 1730 may be metallic or ceramic, it may be metallic coated with a ceramic, or it may be formed of other material. Frame 1730 may increase a strength of connector tongue 1710 as compared to a connector tongue formed only of printed circuit board 1720. Frame 1730 may have good wear performance. A metal frame 1730 may be oxidized or coated with a ceramic or other material for increased lubricity for even better wear performance, and to insulate it electrically, where necessary. This oxidation or coating may be selective such that portions, such as EMI plates 1734 and notches 1736 of side retention features 1732, are not oxidized or coated such that they may make electrical contact with corresponding features on a corresponding connector (not shown) when the corresponding connector is mated with connector tongue 1710. Specifically, EMI plates 1734 may be exposed such that they may make electrical contact with ground contacts (not shown) near a front of a USB Type-C connector insert (not shown). Notches 1736 may be exposed such that they make electrical contact with side retention springs in sides of an opening in a USB Type-C connector insert. In these and embodiments of the present invention, the coating or oxidation may be done using physical vapor deposition (PVD), ion injection, or other process technique. In one example, a titanium frame 1730 may be at least partially oxidized to form titanium-oxide on at least a part of the surface of frame 1730. The use of these materials for side retention features 1732 of frame 1730 may also provide a clear tactile and audible response to a user when a user mates a connector having connector tongue 1710 with a corresponding connector, as compared to a plastic or printed circuit board tongue without side retention features 1732.

In various embodiments of the present invention, frame 1730 may be made in different ways. For example, frame 1730 may be formed using metal-injection molding, 3-D printing, forging, stamping, or other process. Printed circuit board 1720 may be made using various techniques. Printed circuit board 1720 may be a multilayer board and it may have a central ground plane or other ground planes (not shown). Printed circuit board 1720 may be a multilayer printed circuit board comprising a plurality of traces (not shown) on each of a plurality of layers (not shown), and further comprising a plurality of vias (not shown) each connecting two traces on different layers in the plurality of layers to each other. Printed circuit board 1720 may include multiple layers supporting traces and planes (not shown) and may further include vias for connecting traces and planes on different layers to each other. Ground connections (not shown) may be made from a ground plane (not shown) in printed circuit board 1720 to frame 1730. For example, one or more vias (not shown) may connect the ground plane to top and bottom surfaces of printed circuit board 1720 adjacent to EMI plates 1734. EMI plates 1734 may then be connected to the ground plane in printed circuit board 1720. In these and other embodiments of the present invention, the ground plane may extend to a side of printed circuit board 1720. The side of printed circuit board 1720 may be edge plated, where the edge plating (not shown) connects to the ground plane. The edge plating may then be electrically connected to side retention features 1732 to form a ground path.

In these and other embodiments of the present invention, frame 1730 may strengthen and increase the durability of connector tongue 1710. Portions of frame 1730 may be soldered to printed circuit board 1720 to further strengthen connector tongue 1710. For example, adjoining sides of printed circuit board 1720 and side retention features 1732 may be soldered together. The area between EMI plates 1734 and a top and bottom of printed circuit board 1720 board may be soldered, thereby greatly increasing the strength of connector tongue 1710. Solder paste may be applied to surfaces of printed circuit board 1720. After printed circuit board 1720 is pushed into frame 1730, the solder paste may be heated and the solder may connect these surfaces. Capillary action may cause the solder paste to flow and fill gaps between printed circuit board 1720 and frame 1730.

In these and other embodiments of the present invention, one or more electronic devices or components 1740, such as data retiming circuits, impedance circuits, light-emitting diodes, and others may be located on printed circuit board 1720 on a rear portion of connector receptacle board 1700 and may be connected to contacts 1722 and other connections (not shown) to printed circuit board 1720 through traces in printed circuit board 1720. Circuits and components 1740 may be shielded by shield 1750. Printed circuit board 1720 may further include openings 1726. Openings 1726 may accept fasteners (not shown) that may be used to attach connector receptacle board 1700 to a device enclosure (not shown). Printed circuit board 1720 may include contacts on an underside of rear portion 1712, for example below circuits and components 1740. These contacts may form electrical connections with contacts 1792 (shown in FIG. 18) on flexible circuit board 1790. Flexible circuit board 1790 may then route signals from tongue 1710 contacts 1722 and devices and components 1740 to other circuits and components in an electronic device housing the tongue 1710.

In these and other embodiments of the present invention, printed circuit board 1720 may be formed of various materials with a reduced concern for their wear or strength since printed circuit board 1720 is reinforced with frame 1730. This may allow the use of different or specialized materials for a higher-performing printed circuit board 1720. Also, printed circuit board materials may be more freely selected for color, signal quality, aesthetics, availability, or other property.

Figure 18:
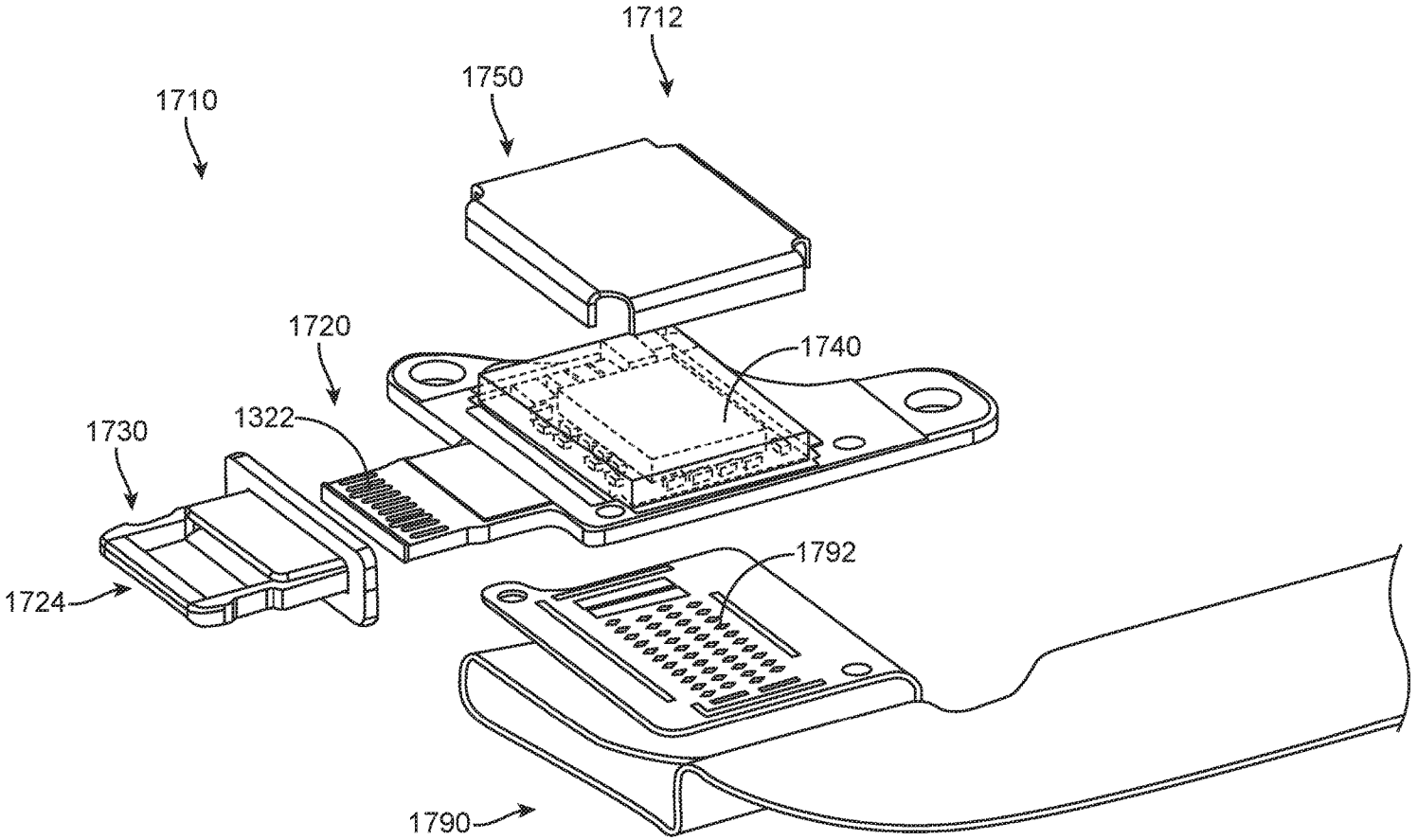
FIG. 18 illustrates an exploded view of the receptacle tongue of FIG. 17.

FIG. 18 illustrates an exploded view of the receptacle tongue of FIG. 17. In this example, frame 1730 may include cross-beam 1724. Cross-beam 1724 may be printed or encapsulated with an overmold. Tongue 1710 may support a number of components 1470 which may be shielded by shield 1750. Contacts (not shown) on the underside of printed circuit board 1720 may electrically connect to contacts 1792 on a surface of flexible circuit board 1790. Contacts 1722 may connect to components 1740 and the contacts on the underside of board 1720 through traces in board 1720. In this way, contacts 1722 and circuits and components 1740 on printed circuit board 1720 may be connected through flexible circuit board 1790 to other circuits and components in an electronic device housing tongue 1710.

While embodiments of the present invention may be useful as connector tongues in USB Type-C connector receptacles, these and other embodiments of the present invention may be used as connector tongues in other types of connectors for different interfaces.

In various embodiments of the present invention, frames, shields, and other conductive portions of a connector tongue may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the reflow caps and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide connector tongues for connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles and connector inserts that may be used to provide a reduced set of functions for one or more of these standards. In various embodiments of the present invention, these interconnect paths provided by these connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector tongue comprising:

a printed circuit board having a front edge, a top side, a bottom side, and two lateral sides between the top side and the bottom side;

a plurality of contacts each having a leading edge near the front edge of the printed circuit board and located on the top side and the bottom side of the printed circuit board; and a frame including two side retention features, each adjacent to a corresponding lateral side of the printed circuit board and extending along the corresponding lateral side of the printed circuit board towards the front edge of the printed circuit board to the leading edges of the plurality of contacts on the printed circuit board.

2. The connector tongue of claim 1 wherein the frame is metal.

3. The connector tongue of claim 2 wherein the frame is formed by metal-injection molding.

4. The connector tongue of claim 3 wherein the frame further comprises a flange connecting the side retention features near a rear of the connector tongue.

5. The connector tongue of claim 4 wherein the frame further comprises a first EMI plate on the top side of the printed circuit board and a second EMI plate on the bottom side of the printed circuit board.

6. The connector tongue of claim 5 wherein the first EMI plate is soldered to the top side of the printed circuit board and the second EMI plate is soldered to the bottom side of the printed circuit board.

7. The connector tongue of claim 6 further comprising a rib along a portion of an inside edge of each of the side retention features.

8. The connector tongue of claim 7 wherein each rib is in contact with a lateral side of the printed circuit board.

9. The connector tongue of claim 6 wherein the flange comprises a rear opening through which the printed circuit board is located.

10. The connector tongue of claim 9 wherein the rear opening of the flange includes angled corners, the angled corners in contact with corners of the printed circuit board.

11. The connector tongue of claim 6 wherein the frame further comprises a front cross-beam connecting each of the side retention features.

12. The connector tongue of claim 11 wherein the front cross-beam is covered in plastic.

13. The connector tongue of claim 6 wherein a portion of the frame is oxidized.

14. The connector tongue of claim 13 wherein the frame is formed of titanium.

15. The connector tongue of claim 6 wherein a portion of the frame is coated with a ceramic.

16. The connector tongue of claim 1 wherein the side retention features extend to the front edge of the printed circuit board.

17. A connector tongue comprising:

a top printed circuit board comprising:

a first plurality of contacts on a top side;

a second plurality of contacts on a bottom side; and a plurality of traces connecting the first plurality of contacts and the second plurality of contacts;

an intermediate flexible circuit board having a first plurality of contacts on a top side connected to the second plurality of contacts on the top printed circuit board and a second plurality of contacts on a bottom side;

a bottom printed circuit board comprising:

a first plurality of contacts on a bottom side;

a second plurality of contacts on a top side connected to the second plurality of contacts on the bottom side of the intermediate flexible circuit board; and a plurality of traces connecting the first plurality of contacts and the second plurality of contacts; and a metallic frame comprising side retention features along each lateral edge of the top printed circuit board and the bottom printed circuit board.

18. The connector tongue of claim 17 wherein the metallic frame further comprises a bridge between the side retention features, wherein the bridge is attached to ground regions on a bottom side of the top printed circuit board and the top side of the bottom printed circuit board.

19. The connector tongue of claim 18 wherein the metallic frame further comprises a first EMI plate on a top side of the connector tongue and a second EMI plate on a bottom side of the connector tongue, wherein the first EMI plate and the second EMI plate are attached to ground regions on a top side of the top printed circuit board and the bottom side of the bottom printed circuit board.

20. The connector tongue of claim 17 wherein the first plurality of contacts each have a leading edge near a front edge of the top printed circuit board, and wherein the metal frame comprises two side retention features each adjacent to a lateral side of the top printed circuit board and extending along the lateral side of the top printed circuit board to the leading edges of the first plurality of contacts on the top printed circuit board.

21. The connector tongue of claim 20 wherein the side retention features extend to the front edge of the top printed circuit board.

22. A connector tongue comprising:

a top printed circuit board comprising:

a first plurality of contacts on a top side;

a second plurality of contacts on a bottom side; and a plurality of traces connecting the first plurality of contacts and the second plurality of contacts;

an intermediate flexible circuit board having a first plurality of contacts on a top side connected to the second plurality of contacts on the top printed circuit board and a second plurality of contacts on a bottom side;

a bottom printed circuit board comprising:

a first plurality of contacts on a bottom side;

a second plurality of contacts on a top side connected to the second plurality of contacts on the bottom side of the intermediate flexible circuit board; and a plurality of traces connecting the first plurality of contacts and the second plurality of contacts; and a metal frame around sides of the top printed circuit board.

23. The connector tongue of claim 22 wherein the first plurality of contacts each have a leading edge near a front edge of the top printed circuit board, and wherein the metal frame comprises two side retention features each adjacent to a lateral side of the top printed circuit board and extending along the lateral side of the top printed circuit board to the leading edges of the first plurality of contacts on the top printed circuit board.

24. The connector tongue of claim 23 wherein the side retention features extend to the front edge of the top printed circuit board.

* * * * *